US006109724A

United States Patent [19]

Takahashi et al.

[11] Patent Number: 6,109,724

[45] **Date of Patent: *Aug. 29, 2000**

[54] INK JET RECORDING APPARATUS

[75] Inventors: Kazuyoshi Takahashi, Kawasaki; Yasuhiro Numata, Yokohama; Koji Terasawa, Mitaka; Hideo Fukazawa, Yokohama; Hitoshi Miyazaki, Kawasaki; Takao Aichi, Tokyo, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/517,823

[22] Filed: Aug. 22, 1995

Related U.S. Application Data

[62] Division of application No. 08/304,215, Sep. 12, 1994, Pat. No. 5,475,404, which is a continuation of application No. 07/960,281, Oct. 13, 1992, abandoned, which is a continuation of application No. 07/795,246, Nov. 15, 1991, abandoned, which is a continuation of application No. 07/653,240, Feb. 11, 1991, abandoned.

[30] Foreign Application Priority Data

| | | | |
|---|---|---|---|
| Feb. 13, 1990 | [JP] | Japan | 2-029393 |
| Apr. 11, 1990 | [JP] | Japan | 2-094089 |
| May 22, 1990 | [JP] | Japan | 2-131910 |
| Jan. 18, 1991 | [JP] | Japan | 3-018254 |

[51] Int. Cl.[7] ..... B41J 2/165

[52] U.S. Cl. ..... 347/23

[58] Field of Search ..... 347/23, 29, 30, 347/31, 35

[56] References Cited

U.S. PATENT DOCUMENTS

| | | | |
|---|---|---|---|
| 4,001,839 | 1/1977 | Kraus | 346/140 R |
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,540,997 | 9/1985 | Biggs et al. | 347/23 |
| 4,558,332 | 12/1985 | Takahashi | 346/140 R |
| 4,558,333 | 12/1985 | Sugitani et al. | 346/140 R |
| 4,577,203 | 3/1986 | Kawamura | 346/140 R |
| 4,692,777 | 9/1987 | Hasumi | 347/23 |
| 4,712,172 | 12/1987 | Kiyohara et al. | 346/1.1 |
| 4,723,129 | 2/1988 | Endo et al. | 347/56 |
| 4,740,796 | 4/1988 | Endo et al. | 347/56 |
| 4,791,437 | 12/1988 | Accattino et al. | 346/140 R |
| 4,925,788 | 5/1990 | Kashio | 346/75 |
| 4,925,789 | 5/1990 | Kashio | 346/75 |
| 4,926,196 | 5/1990 | Mizoguchi et al. | 346/140 R |
| 4,967,204 | 10/1990 | Terasawa et al. | 347/23 |
| 4,970,527 | 11/1990 | Gatten | 347/35 |
| 4,977,459 | 12/1990 | Ebinuma et al. | 358/296 |
| 5,055,861 | 10/1991 | Murayama et al. | 346/140 R |
| 5,341,163 | 8/1994 | Hanabusa | 347/23 |
| 5,543,826 | 8/1996 | Kuronuma et al. | 347/23 |

FOREIGN PATENT DOCUMENTS

| | | | |
|---|---|---|---|
| 54-056847 | 5/1979 | Japan . | |
| 55-082660 | 6/1980 | Japan . | |
| 59-123670 | 7/1984 | Japan . | |
| 59-138461 | 8/1984 | Japan . | |
| 60-002368 | 1/1985 | Japan | 347/30 |
| 60-071260 | 4/1985 | Japan . | |
| 249759 | 11/1986 | Japan | 347/23 |
| 63-132058 | 6/1988 | Japan . | |
| 63-145037 | 6/1988 | Japan . | |
| 63-160846 | 7/1988 | Japan . | |
| 64-001575 | 1/1989 | Japan . | |
| 1180352 | 7/1989 | Japan . | |

*Primary Examiner*—John Barlow
*Assistant Examiner*—Michael S. Brooke
*Attorney, Agent, or Firm*—Fitzpatrick, Cella, Harper & Scinto

[57] ABSTRACT

An ink jet recording apparatus comprising, timer means for measring an elapse time from a predetermined measurement start timing, a backup power source for supplying power to said timer means when a main power source is turned off, and control means for changing a content and/or the number of times of a recover operation for recovering and preventing a discharge error in a discharge port for discharging an ink on the basis of the elapse time.

12 Claims, 21 Drawing Sheets

INK JET RECORDING APPARATUS

This application is a division of application Ser. No. 08/304,215, now U.S. Pat. No. 5,475,404 filed Sep. 12, 1994, which in turn is a continuation of application Ser. No. 07/960,281, filed Oct. 13, 1992, now abandoned, which in turn is a continuation of application Ser. No. 07/795,246, filed Nov. 15, 1991, now abandoned, which in turn is a continuation of application Ser. No. 07/653,240, filed Feb. 11, 1991, now abandoned.

BACKGROUND OF THE INVENTION

1. Field of the Invention

The present invention relates to an ink jet recording apparatus for discharging ink from discharge ports of an ink jet recording head to perform recording.

2. Related Background Art

Recording apparatuses such as printers, copying machines, facsimile systems, and the like, which are used together with computers or wordprocessors, or are used, individually feed and convey sheet-like recording media such as paper sheets or plastic thin plates, and record images on the recording media on the basis of image information. The recording apparatuses can be classified into an ink jet system, a wire-dot system, a thermal system, a laser beam system, and the like depending on their recording systems.

Of these systems, the ink jet recording system (ink jet recording apparatus) causes recording means (recording head) to discharge ink toward a recording medium to perform recording. The ink jet recording system has the following advantages. That is, the system can record a high-quality image at high speed, and can perform recording on normal paper without always requiring special treatment. Since the ink jet recording system is a non-impact system, noise is low, and it is easy to record a color image using many color inks. Of the ink jet recording system, an ink jet recording apparatus employing a line-type recording means in which a large number of discharge ports are aligned in the widthwise direction of a paper sheet can attain recording operations at a higher speed.

In particular, in an ink jet recording means (recording head) which uses heat energy as energy for discharging ink, electrothermal transducers which are formed on a substrate via semiconductor manufacturing processes such as etching, deposition, sputtering, and the like, liquid path walls, a top plate, and the like are formed, so that a recording head having a high-density liquid path arrangement (discharge port arrangement) can be easily manufactured.

Such an ink jet recording apparatus normally comprises an arrangement for keeping a satisfactory ink discharging state by preventing an increase in ink viscosity due to evaporation of an aqueous ink component in discharge ports or a portion around them where a recording liquid (ink) contacts air, or by removing an ink whose viscosity is increased.

In particular, in a recording head of a type for discharging an ink by utilizing heat energy, since discharge ports and liquid paths communicating with the ports can be arranged very precisely at a high density, the influence of an increase in ink viscosity tends to be relatively increased.

For this reason, each of these ink jet recording apparatuses comprises a capping mechanism for covering and closing (capping) a surface where discharge ports of a recording head are arranged in a non-recording operation state during which no ink is discharged, thereby preventing evaporation of an aqueous ink component from the discharge ports. In order to assure stable ink discharge, ink is periodically discharged from all or desired discharge ports of a recording head at a predetermined position during, e.g., a recording operation, thus performing so-called preliminary discharge (idle discharge) for renewing an ink in particular discharge ports which are not involved in recording. In addition, an ink absorbing recover or ink compression recover operation for discharging a viscosity-increased ink or a foreign matter by absorbing or compressing an ink in the discharge ports at the beginning of recording or at predetermined time intervals is performed.

However, for example, when capping of an ink jet recording head is performed by executing a series of power-off sequences, a circuit for operating an activating source such as a motor for a predetermined period of time by, e.g., a relay is required, resulting in a complex apparatus arrangement. In addition, upon completion of a recording operation, a power source cannot be turned off until the power-off sequences are completed, resulting in an inconvenience. Furthermore, in this case, attachment of a foreign matter or dust can be prevented by capping the ink jet recording head. However, since an increase in viscosity of an ink in the ink jet recording head cannot be satisfactorily prevented, this may cause a discharge error including an ink non-discharge state in the next recording operation.

When ink is forcibly discharged upon a power-on operation of the ink jet recording apparatus, a fixed amount of ink is always discharged although the degree of increase in viscosity of ink in the ink jet recording head varies depending on the non-use time of the ink jet recording apparatus. For this reason, when a power source is frequently turned on/off, steps against wasting ink, an increase in running cost, contamination of the interior of the apparatus due to the discharged ink, and the like must be taken.

Furthermore, since recover operations such as absorbing, compression, and idle discharge operations are added, time is wasted in addition to an original recording time, and as the result, a recording speed is undesirably lowered.

Moreover, when an ink jet recording apparatus is left for a long period of time while its power source is kept OFF, or is left in a low-temperature condition, a discharge error (e.g., unstable discharge or non-discharge state) may occur due to an increase in viscosity of an ink or sticking of an ink in the ink discharge ports. As a method of solving this problem, sequences for performing recover operations of a recording means (recording head) upon a power-on operation are performed, as described above. In the conventional power-on recover operations, an absorbing recover operation is constantly performed regardless of the environmental temperature of the recording means, or the temperature around the recording means is detected only upon a power-on operation, and the number of times the absorbing recover operation is conducted increased/decreased according to the detected temperature, thus changing a treatment level.

However, in the conventional recover method, judgment of an ink sticking state in the discharge ports can only be made by a detected temperature around the recording means upon a power-on operation. For example, when an abrupt change in temperature occurs immediately before use of the recording apparatus, or when the recording apparatus is left in a low-temperature state for a long period of time before the power source is turned on, it is impossible to correctly determine an ink sticking state of the recording means (recording head). FIG. 25 is a graph for exemplifying a change in temperature when a temperature of the recording means is abruptly increased immediately before the recording apparatus is used, and FIG. 26 is a graph for exemplifying a change in temperature of the recording means when the apparatus is left in a low-temperature state for a long period of time before the power source is turned on. In FIGS. 25 and 26, a standard temperature corresponds to a temperature at which an ink sticking phenomenon begins below this temperature.

For these reasons, the conventional control method of recover operations of the recording means cannot determine an ink sticking state upon a power-on operation due to a hysteresis temperature before the power source is turned on. Therefore, since the recover operations upon a power-on operation cannot be performed according to an actual ink sticking state, control becomes unsatisfactory. As a result, an ink discharging state in recording becomes unstable, and recording quality cannot be maintained. In order to guarantee stability of an ink discharging state, recover operations must be excessively performed, and waste of ink and time cannot be avoided.

SUMMARY OF THE INVENTION

It is an object of the present invention to provide an ink jet recording apparatus which can efficiently perform a head recover operation by discharging ink, and can maintain an ink jet recording head in a normal ink discharging state.

It is another object of the present invention to provide an ink jet recording apparatus which can control an ink amount consumed in preliminary discharge within a necessary range, and can prevent waste of an ink even when ON/OFF operation of a power source of the recording apparatus is repeated a large number of times (frequently) within a short period of time.

It is still another object of the present invention to provide an ink jet recording apparatus which measures at least one of a time elapsed from a previous idle discharge operation, a time elapsed from a previous absorbing operation, and a time of a capping state or an uncapping state to appropriately select a treatment content of a recover operation, and can eliminate waste of ink and a loss in recording time due to an unnecessary idle discharge or absorbing operation.

It is still another object of the present invention to provide an ink jet recording apparatus which can avoid an unnecessary discharge stabilization treatment on the basis of a hysteresis of the discharge stabilization treatment.

It is still another object of the present invention to provide an ink jet recording apparatus which can correctly judge an ink sticking state upon a power-on operation to optimize a recover operation upon a power-on operation, thereby eliminating a recording error caused by a discharge error, and preventing waste of an ink and time caused by a wasteful recover treatment upon a power-on operation.

It is still another object of the present invention to provide an ink jet recording apparatus comprising timer means for measuring an elapse of time from a predetermined measurement start timing, a backup power source for supplying power to the timer means when a main power source is turned off, and control means for changing the content and/or the frequency of a recover operation for recovering and preventing a discharge error in a discharge port for discharging an ink on the basis of the elapsed time.

The ink jet recording apparatus performs a head recover operation for discharging ink from an ink jet recording head when a power source is turned on, thereby removing foreign matter, e.g., a viscosity-increased ink in the ink jet recording head, which causes discharge errors including an ink non-discharge state. A non-use time in which no recording operation is performed, i.e., from a power-off operation until the next power-on operation is counted, and an ink discharge amount in a head recover treatment can be set according to the counted non-use time. Therefore, when the non-use time is short, and ink viscosity is low, an ink discharge amount is limited to suppress an ink consumption amount. On the other hand, when the non-use time is long and an ink viscosity is high, an ink discharge amount is increased to reliably remove the foreign matter.

Since a timer for counting the non-use time of the ink jet recording apparatus is reset upon completion of the head recover operation, even when the power source is turned off immediately after it is turned on, the timer will not be reset as long as the head recover operation is not completed, and counts the non-use time, i.e., a non-recording operation time from a power-off operation upon completion of the previous head recover operation. Therefore, when the power source is turned on for the next time, the head recover operation can be performed in accordance with an ink discharge amount according to the non-use time.

Furthermore, a number of discharge stabilization treatments including idle discharge and ink absorbing operations is selected in accordance with at least one of an elapse of time from the last ink discharge or ink absorbing operation or an elapse of time in a capping state or an uncapping state. Since the elapsed time can be calculated even when the power source of the ink jet recording apparatus is not turned on, a discharge state of the recording head during a non-use time of the apparatus can be administered.

In addition, a power-off control unit measures the temperature near a recording means in a power-off state (e.g., measures the temperature every minutes during 30 minutes until a power-on operation), and controls the number of recover operations or an absorbing force upon a power-on operation in accordance with parameters indicating the number of measurement values below a standard temperature, the number of continuous measurement values below the standard temperature, and the like, thus optimizing a recover operation.

DETAILED DESCRIPTION OF THE PREFERRED EMBODIMENTS

An embodiment of the present invention will be described hereinafter with reference to accompanying drawings.

Figure 1:
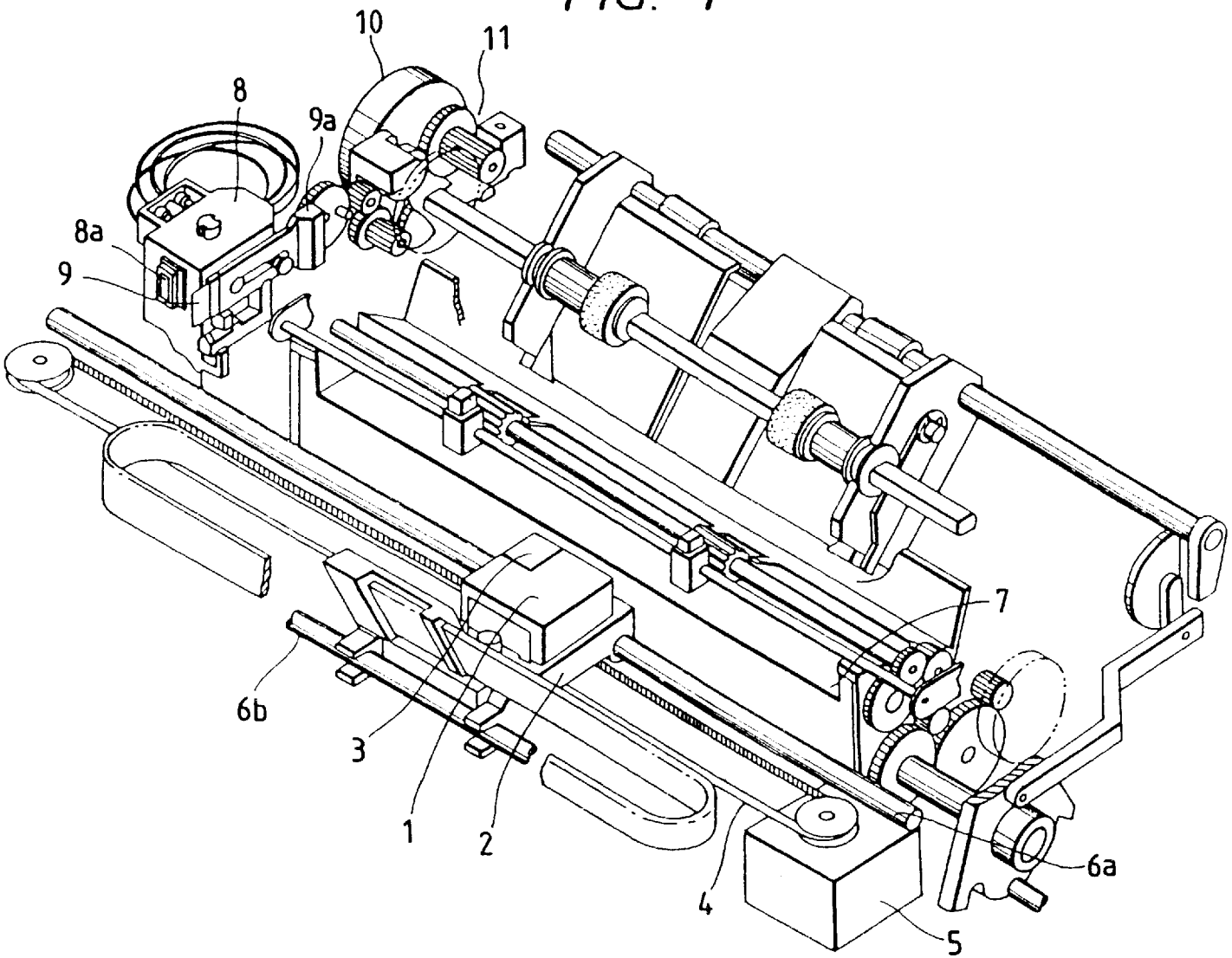
FIG. 1 is a perspective view showing an embodiment of an ink jet recording apparatus according to the present invention.

In the ink jet recording apparatus of this embodiment, as shown in FIG. 1, an ink jet head cartridge 1 integrating an ink jet recording head 3 and an ink tank (not shown) is mounted on a carriage 2, and the carriage 2 is coupled to a portion of an activating belt 4 for transmitting an activating force of an actuating motor 5. The carriage 2 is slidable along two parallel guide shafts 6*a* and 6*b*. The carriage 2 is reciprocally moved over the total width of a recording medium fed from a medium feeding device (not shown) to a platen 7 arranged to oppose a discharge surface of the ink jet recording head 3, so that the ink jet recording head 3 performs recording on the recording medium.

Figure 2:
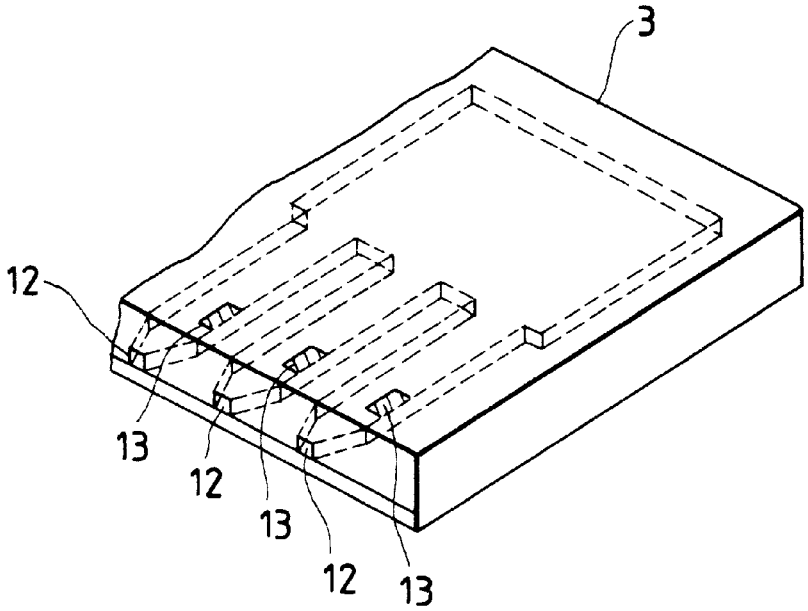
FIG. 2 is a perspective view showing a recording head.

As shown in the partial perspective view in FIG. 2, a plurality of ink discharge ports 12 are juxtaposed on the discharge surface opposing the recording medium, and electrothermal transducers 13 for generating energy for discharging ink and applying it to an ink path communicating with the discharge ports 12 are arranged in correspondence with the discharge ports 12.

The ink jet recording apparatus comprises a head recovering device 8 comprising a cap member 8*a* for capping the discharge surface of the ink jet recording head 3. The head recovering device is activated by an activating force of a cleaning motor 10 via a transmission mechanism 11 at a position which falls outside a range of a reciprocal movement of the ink jet recording head 3 in a recording operation, and where the ink jet recording head is stopped in a non-recording mode (i.e., the left end of the guide shaft 6*a* in FIG. 1; to be referred to as a "home position" hereinafter) when a head recover operation of the ink jet recording head 3 is performed. The head recovering device 8 forces ink to be discharged from the discharge ports 12 by performing an ink absorbing operation by an absorbing means as an ink supply means to an ink path in association with the capping operation of the discharge surface of the recording head 3 by the cap member 8*a* during the head recover operation. Thus, the head recover operation is performed to remove a viscosity-increased ink in the recording head 3. In addition, a controller (to be described later) drives the electrothermal transducers 13 of the recording head 3 to perform preliminary discharge of the ink jet recording head 3 in association with capping of the discharge surface of the recording head 3 by the cap member 8*a*, or drives the electrothermal transducers 13 so as not to discharge ink, thus decreasing viscosity of an ink in the ink path of the recording head 3. The head recover operation can also be performed in this manner.

Furthermore, a blade(wiping member)9 formed of silicone rubber is held by a blade holding member 9*a* on a side surface of the head recovering device 8 in a cantilever manner, and is operated by the cleaning motor 10 and a transmission mechanism 11 like in the head recovering device 8, thus allowing frictional engagement with the discharge surface of the ink jet recording head 3. Thus, after the head recover operation using the head recovering device 8, the blade wiping member 9 projects into, the moving path of the ink jet recording head 3, and wipes dew, wetting ink, dust, or the like on the discharge surface of the recording head 3 upon movement of the ink jet recording head 3.

A control system of this embodiment will be described below with reference to FIG. 3.

Figure 3:
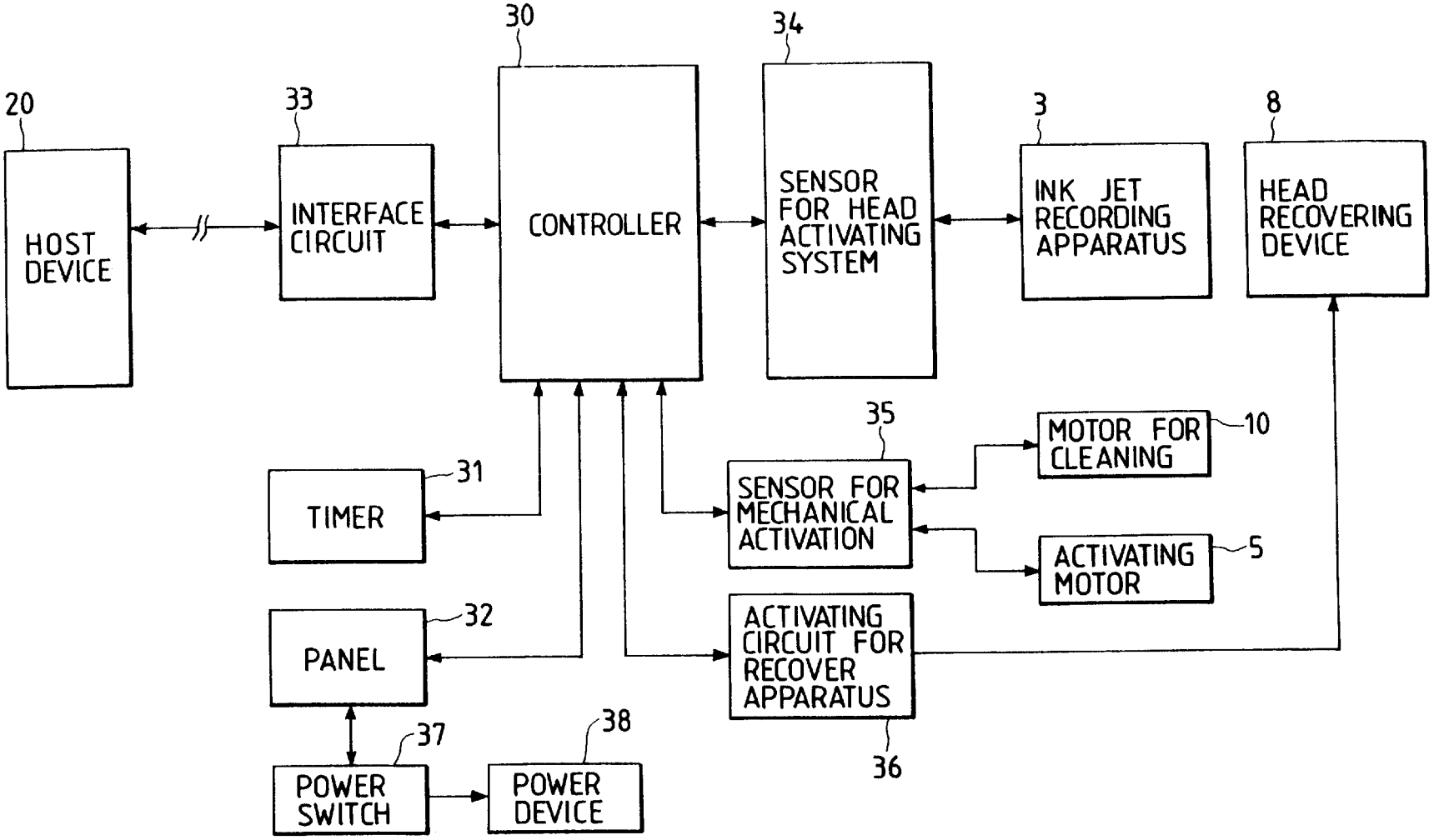
FIG. 3 is a block diagram showing the ink jet recording apparatus shown in FIG. 1.

FIG. 3 is a block diagram showing the ink jet recording apparatus described above, and illustrates a state wherein the ink jet recording apparatus is connected to a host device 20 as an external device.

When a power switch 37 is turned on, a power source voltage is applied from a power device 38, and a controller 30 starts its operation. In this manner, the ink jet recording apparatus of this embodiment is started. When the power switch 37 is turned on, a power-on indication is made on a panel 32. The panel 32 is one for operations, which comprises a display means, and switches, e.g., a recording paper feed switch, and is connected to the controller 30. The display means can display an operation mode, e.g., a recording operation mode, a head recover operation mode, and the like in addition to the power-on indication.

The recording operation and the head recover operation of the ink jet recording apparatus are controlled by the controller 30. The controller 30 is connected to a sensor 34 for a head activating system for activating the electrothermal transducers 13 of the ink jet recording head 3, a sensor 35 for a mechanical activating system for activating the activating motor 5 and the cleaning motor 10, and an activating circuit 36 for the recovering device for activating an absorbing means of the head recovering device 8. The controller 30 receives document information from the host device 20 as an external device via an interface circuit 33, and activates the electrothermal transducers 13 of the recording head 3 via the sensor 34, thus causing the recording head 3 to discharge ink. The controller 30 is also connected to a timer 31 which is set when the power switch 37 is turned off, and is reset upon completion of the head recover operation.

Figure 4:
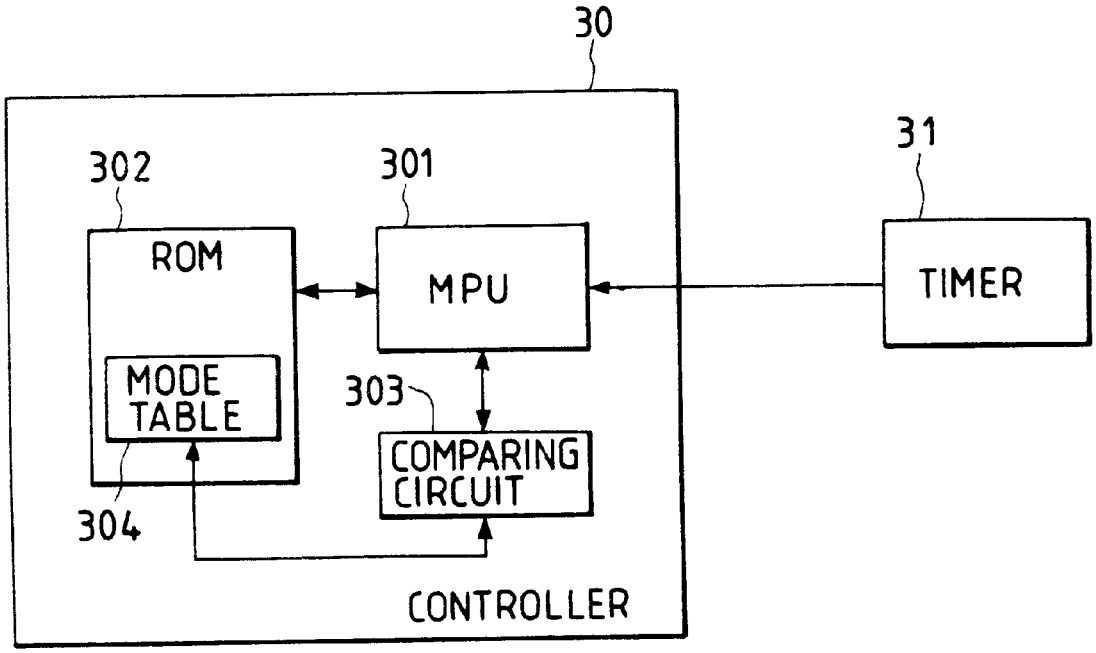
FIG. 4 is a block diagram showing a controller.

The arrangement of the controller 30 will be described below with reference to FIG. 4.

The controller 30 of this embodiment comprises an MPU 301, a ROM 302, and a comparing circuit 303. The MPU 301 performs control operations associated with the recording operation and the head recover operation in accordance with a program prestored in the ROM 302. In this embodiment, it is determined by the program that the head recover operation is performed when the power switch of the ink jet recording apparatus is turned on.

The MPU 301 sets a timer 31 when the power switch 37 of the ink jet recording apparatus is turned off, and resets the timer 31 upon completion of the head recover operation. When the power switch of the ink jet recording apparatus is turned on, the MPU 31 reads a count number of the timer 31 at that time, and transfers it to the comparing circuit 303. Therefore, the count number of the timer 31 indicates a non-use time between an OFF operation of the power switch to the next ON operation of the ink jet recording apparatus. Upon reception of the count number of the timer 31 read by the MPU 301, the comparing circuit 303 looks up a mode table 304 shown in Table 1 below and prestored in the ROM 302 together with the program, selects an operation mode suitable for an elapse of time corresponding to the received count number, and transfers it to the MPU 301.

TABLE 1

| Elapse Time | Recover Operation Mode |
|---|---|
| Within 6 Hours | Preliminary Discharge ($N_1$ Times) |
| More Than 6 Hours to 3 Days | Preliminary Discharge ($N_2$ Times) |
| More Than 3 Days to 10 Days | Ink Heating + Preliminary Discharge ($N_3$ Times) |
| More than 10 Days to 1 Month | Ink Absorbing ($N_4$ Times) |
| More than 1 Month to 6 Months | Ink Absorbing ($N_5$ Times) |
| More than 6 Months | Ink Absorbing ($N_6$ Times) + Test Pattern Printing |

The above-mentioned mode table 304 defines the recover operation modes to be executed in correspondence with the elapsed times in the head recover operation. The recover operation modes include a preliminary discharge mode, an ink heating mode, an ink absorbing mode, a test pattern printing mode, and combinations thereof, as shown in Table 1.

When the recover operation mode selected by the comparing circuit 303 is the preliminary discharge mode, the MPU 301 activates the cleaning motor 10 via the sensor 35 to cause the cap member 8*a* of the head recovering device 8 to cap the discharge surface of the ink jet recording head 3. In this state, the MPU 301 activates the electrothermal transducers 13 of the recording head 3 via the sensor 34 to cause them to perform an ink discharge operation a predetermined number of times. When the selected recover operation mode is a combination of the ink heating mode+the preliminary discharge mode, the MPU 301 activates the electrothermal transducers 13 via the sensor 34 for a predetermined period of time so as not to discharge ink, thereby heating the ink to decrease ink viscosity. Thereafter, the ink discharge operation is performed like in the preliminary discharge mode. When the selected recover operation mode is the ink absorbing mode, the MPU 301 activates the absorbing means in the head recovering device 8 via the activating circuit 36 in a state wherein the discharge surface of the recording head 3 is capped as described above. Thus, the ink absorbing operation is performed at a predetermined absorbing pressure a predetermined number of times, thereby forcibly discharging ink from the discharge ports 12. When the selected recover operation mode is a combination of the ink absorbing mode plus the test pattern printing mode, the forced ink discharge operation of the recording head 3 is performed as described above. Thereafter, the cap member 8*a* is uncapped from the recording head 3, and the electrothermal transducers 13 of the recording head 3 are activated according to printing data representing a predetermined test pattern, thereby printing the test pattern on a recording medium.

Set and reset timings of the timer 31 by the MPU 301 will be described below with reference to FIGS. 5A and 5B.

Figure 5A:
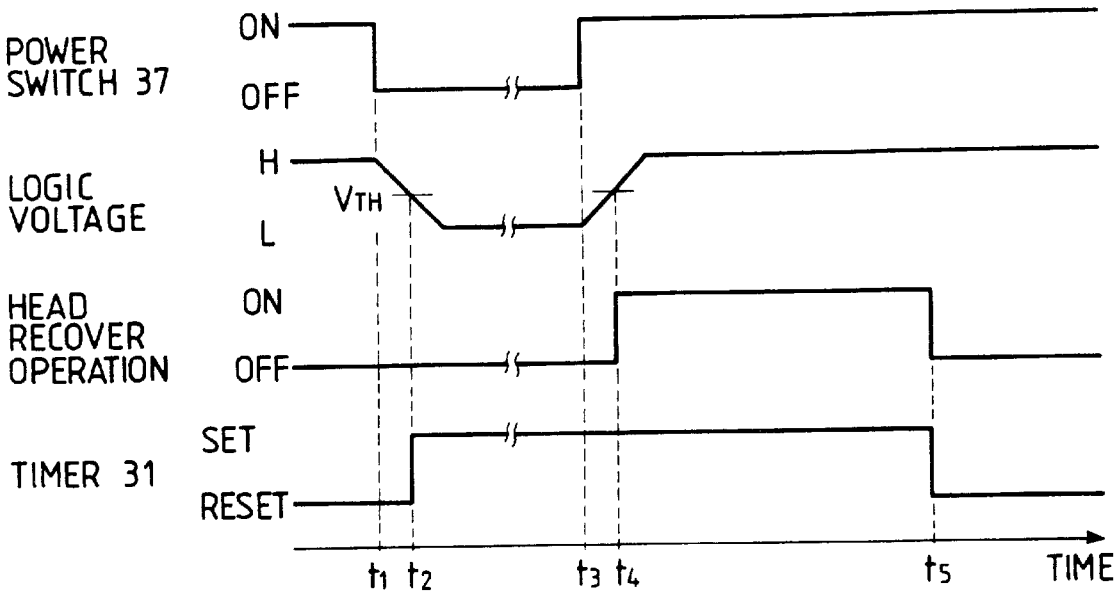
FIGS. 5A and 5B are timings charts showing set and reset timings of a timer by the controller, respectively.

As shown in FIG. 5A, when the power switch 37 of the ink jet recording apparatus is turned off at time $t_1$, supply of the power source voltage from the power device 38 is stopped, and a logic voltage as an operation voltage of the controller 30 begins to fall. When the logic voltage reaches a threshold level $V_{TH}$ of the operation voltage of the controller 30 at time $t_2$, the operation of the controller 30 is stopped, and the timer 31 is set, thus starting a count operation of the timer 31. Thereafter, when the power switch 37 of the ink jet recording apparatus is turned on again at time $t_3$, the logic voltage begins to rise. When the logic voltage reaches the threshold level $V_{TH}$ at time $t_4$, the controller 30 is started, and the head recover operation is executed. When the head recover operation is completed at time $t_5$, the timer 31 is reset by a signal indicating completion of the head recover operation issued by the MPU 301 at that time.

Figure 5B:
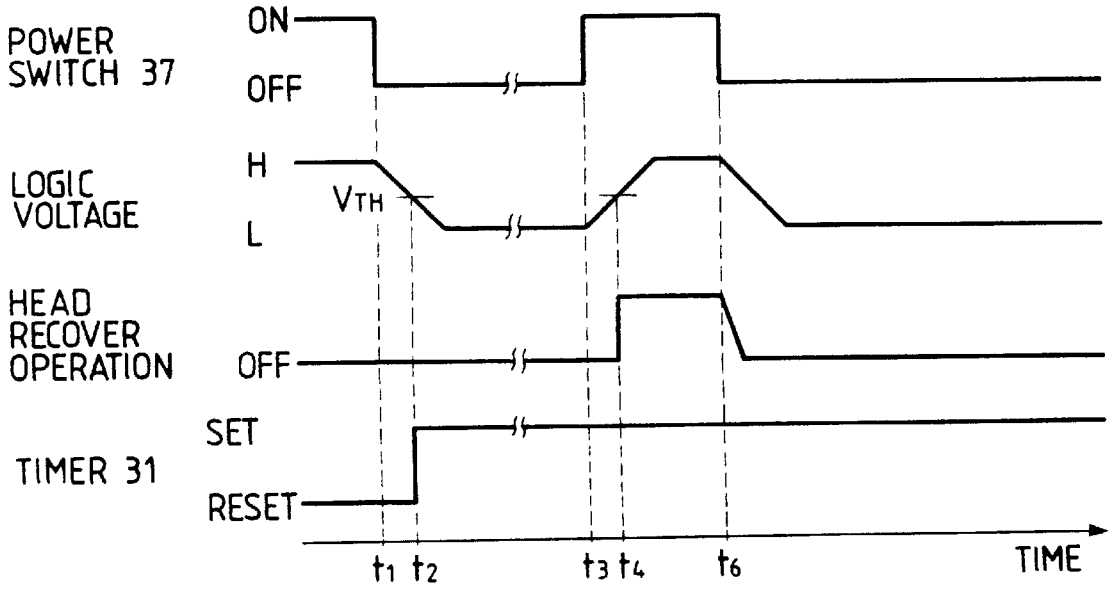

When the power switch 37 is successively turned on/off, and is turned off at time $t_6$ in the middle of the head recover operation, as shown in FIG. 5B, since no signal indicating completion of the head recover operation is output from the MPU 301, the timer 31 is not reset, and keeps counting an elapse of time from the OFF operation of the power switch 37 at time $t_1$ described above.

Figure 6:
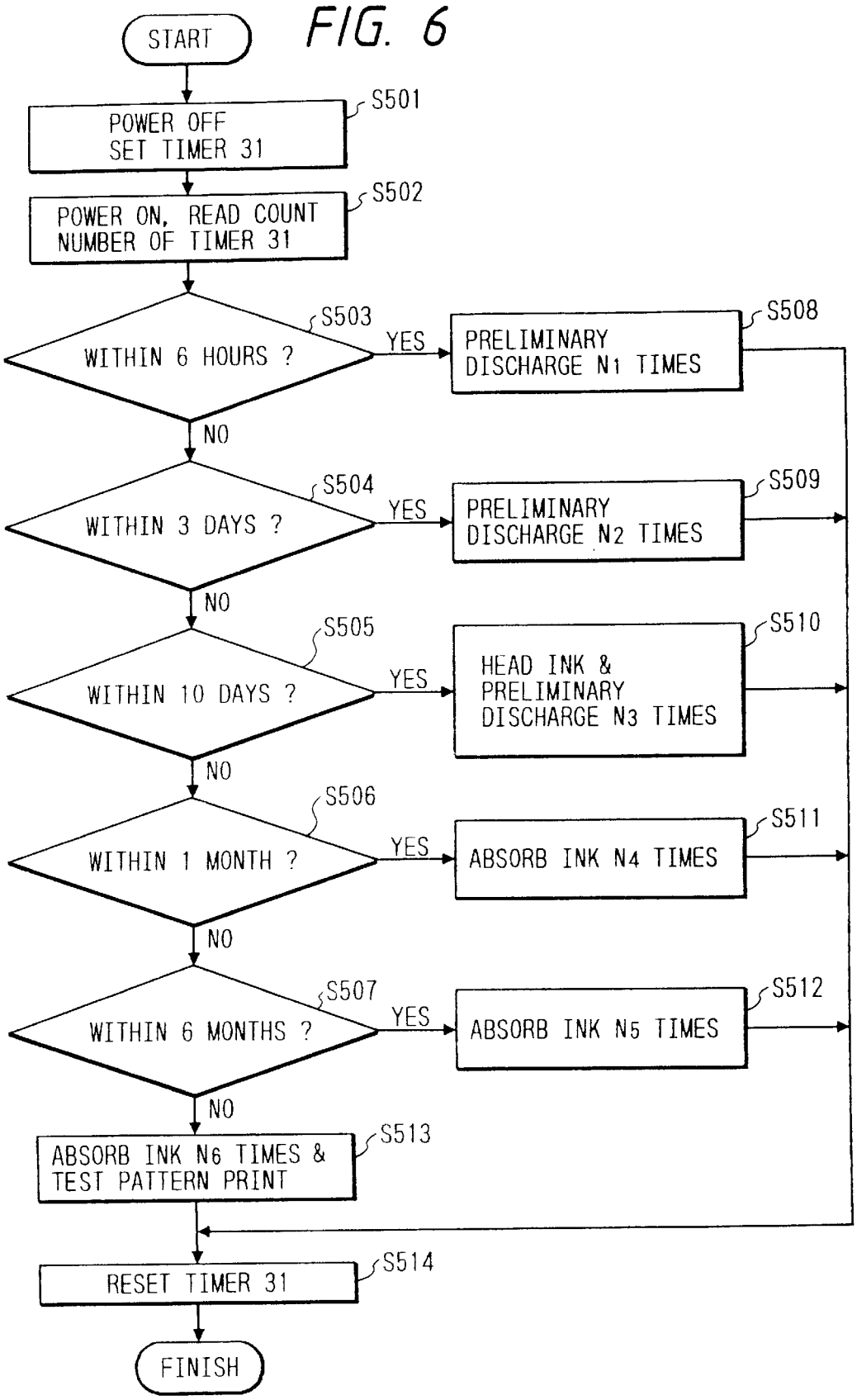
FIG. 6 is a flow chart showing an operation of the ink jet recording apparatus according to the present invention.

The operation of this embodiment will be described below with reference to the flow chart shown in FIG. 6.

When the recording operation of the ink jet recording apparatus is completed, and the power switch 37 is turned off, supply of the power source voltage from the power device 38 is stopped, and the operation of the controller 30 is stopped. At the same time, the timer 31 is set (step S501). Thereafter, the timer 31 counts an elapse of time from the power-off operation by the power switch 37.

When the power switch 37 of the ink jet recording apparatus is turned on again, and the controller 30 is started, the MPU 301 of the controller 30 reads a count number of the timer 31 at that time (step S502). The comparing circuit 303 of the controller 30 sequentially looks up the mode table 304 on the basis of the read count number, selects a recover operation mode suitable for the elapse of time corresponding to the count number (steps S503 to S507), and transfers it to the MPU 301. If the read count number indicates, e.g., four days, "ink heating mode plus preliminary discharge mode ($N_3$ times)" in step S510 is selected. In this case, in the controller 30, the MPU 301 activates the sensors 34 and 35 to execute the ink heating operation, and then to execute the preliminary discharge operation $N_3$ times. Upon completion of these operations, the MPU 301 outputs a signal indicating completion of the head recover operation, thereby resetting the timer 31 (step S514). In this manner, the head recover operation upon a power-on operation of the ink jet recording apparatus is completed, and the recording operation can be started.

In this embodiment, when the ink absorbing operation is performed using the ink absorbing means in the head recover operation, the number of absorbing operations for absorbing ink at a predetermined absorbing pressure is changed in accordance with an elapse of time from the OFF operation of the power switch. Alternatively, an absorbing pressure may be changed while the number of absorbing operations is kept constant.

In place of the absorbing means, compression means for compressing an ink in the ink path of the head may be arranged as the head recovering device. In this case, the number of compression operations or a compression force is changed in accordance with the elapsed time, thus obtaining the same effect as described above.

As described above, the timer is set when the power switch of the ink jet recording apparatus is turned off, and a count number of the timer is read when the power switch of the ink jet recording apparatus is turned on, thus obtaining a non-use time of the ink jet recording apparatus. Furthermore, since an ink discharge amount from the ink jet recording head in the head recovering operation is determined in correspondence with the non-use time, even when the power switch is frequently turned on/off, waste of ink can be avoided, and high-viscosity ink can be reliably removed even when an increase in viscosity of an ink in the ink jet recording head is considerable.

Since the head recover operation is performed when the power switch of the ink jet recording apparatus is turned on, a foreign matter for causing an ink non-discharge state can be reliably removed from the ink jet recording head before a recording operation is started. As a result, image recording precision can be increased, and reliability of the recording apparatus can be improved.

Furthermore, even when the power switch of the ink jet recording apparatus is turned off immediately after it is turned on, the timer will not be reset and keeps counting as long as the head recover operation is not completed. Therefore, a non-use time of the ink jet recording apparatus, in which no recording operation is performed, can be precisely obtained.

Another embodiment of the present invention will be described below with reference to the accompanying drawings.

Figure 7:
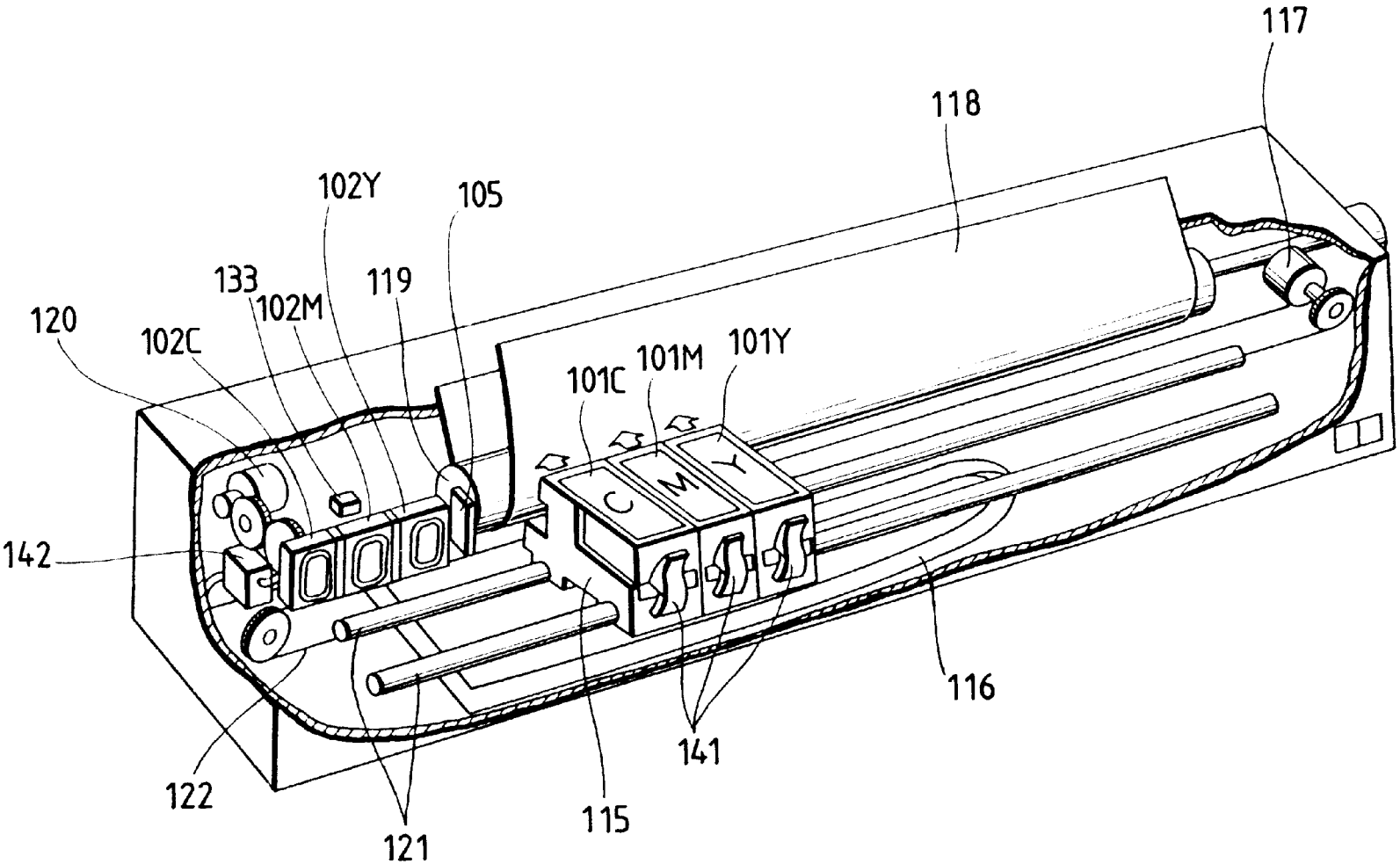
FIG. 7 is a perspective view showing an ink jet recording apparatus according to another embodiment of the present invention.

FIG. 7 is a perspective view of an ink jet recording apparatus according to another preferred embodiment of the present invention.

The ink jet recording apparatus shown in FIG. 7 comprises recording head cartridges 101C, 101M, and 101Y, and colors of ink discharged from these cartridges correspond to C (cyan), M (magenta), and Y (yellow) in the order named. Each of the head cartridges 101C, 101M, and 101Y is integrally formed by an ink tank for storing a corresponding ink, and a recording head for discharging the ink. The head cartridges 101C, 101M, and 101Y are fixed on a carriage 115 by pressing members 141, and the carriage 115 is reciprocally movable along the longitudinal direction of shafts 121. Ink discharged from discharge ports of the recording heads reache is a recording medium 118 whose recording surface is regulated by a platen 119 arranged to be separated from the discharge ports at a small interval, thus forming an image on the recording medium 118.

A discharge signal according to recording data supplied via a cable 116 is applied to electrothermal transducers (for generating heat energy) arranged in the recording heads and serving as discharge energy generation elements for generating energy utilized to discharge ink.

The ink jet recording apparatus also comprises a carriage motor 117 for reciprocally moving the carriage 115 along the shafts 121, and a wire 122 for transmitting an activating force of the motor 117 to the carriage 115. A feed motor 120 rotates the platen roller 119 via a gear train. Thus, the platen roller 119 conveys the recording medium 118 upward in the apparatus.

The apparatus also comprises a wiping blade 105 which partially projects into a moving path adjacent to a recording moving path of the moving path of the head cartridges 101C, 101M, and 101Y. The blade 105 relatively slides along the discharge port surfaces of the recording heads upon reciprocal movement of the head cartridges 101C, 101M, and 101Y to capping positions (to be described later), thereby removing ink or dust attached to the discharge port surfaces. Thus, deflection of a discharge direction of ink droplets discharged from the discharge ports and sticking of the discharge ports due to dried ink can be prevented.

Caps 102C, 102M, and 102Y are arranged along the end portion of the moving path of the head cartridges 101C, 101M, and 101Y in correspondence with these cartridges. The caps 102C, 102M, and 102Y are respectively held by cap holders 102CH, 102MH, and 102YH (not shown in FIG. 7). These cap holders are movable in a direction perpendicular to the moving path of the head cartridges. Note that a moving mechanism for the cap holders is not shown. A tube pump 142 forcibly absorbs ink from the interiors of the discharge ports of the recording heads via the caps 102C, 102M, and 102Y, and will be described in detail later with reference to FIG. 8.

Idle discharge, ink absorbing, and capping operations are performed at the capping positions where these caps 102C, 102M, and 102Y are arranged.

More specifically, in the idle discharge operation, an ink discharge operation is performed a desired number of times toward ink receiving members arranged on the front surface of the respective caps. Thus, ink near the discharge ports which is not frequently discharged is renewed, and viscosity-increased ink is discharged, thereby attaining uniform discharge characteristics among the discharge ports.

In the ink absorbing operation, the caps 102C, 102M, and 102Y are moved to close the discharge port surfaces of the recording heads, and in this state, ink in the discharge ports is absorbed by the tube pump 142. With this operation, viscosity-increased ink and solidified ink around and inside the discharge ports, which are caused by a relatively long non-recording time, can be discharged. In the capping operation, the discharge port surfaces are simply covered by the caps. Thus, ink near the discharge ports can be prevented from drying in a non-recording state.

As can be seen from the above description, the ink absorbing operation has a larger discharge recover effect than that of the idle discharge operation, and ink consumption amount is increased accordingly.

Figure 8:
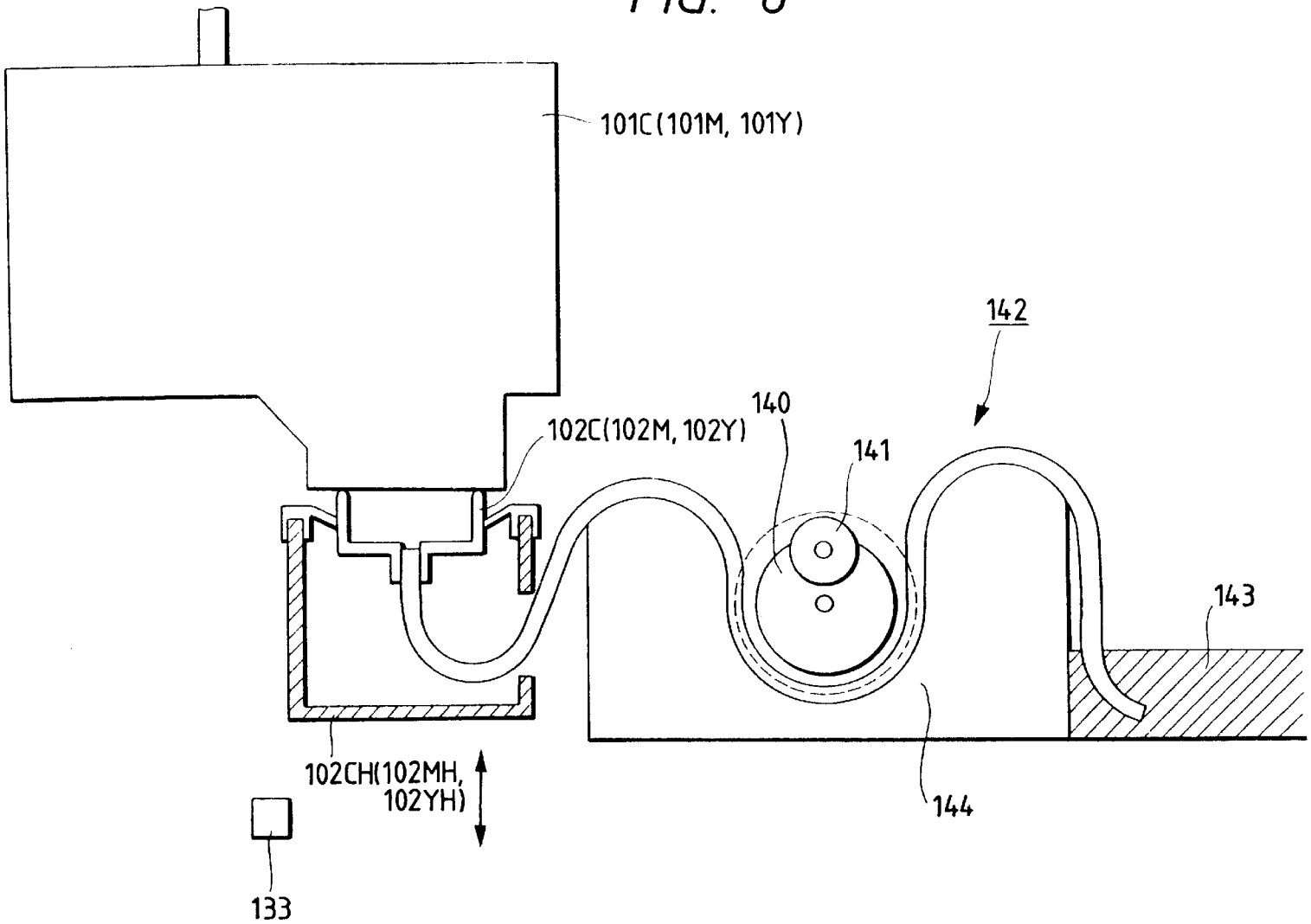
FIG. 8 is a plan view showing in detail a cap and a tube pump shown in FIG. 7.

FIG. 8 is a plan view showing in detail the capping and ink absorbing mechanisms. The caps 102C, 102M, and 102Y are formed of flexible members such as rubber. In a capping mode, the cap holders 102CH, 102MH, and 102YH are moved toward the recording heads by a moving means (not shown), and the caps are pressed against the corresponding discharge port surfaces. Thus, the caps 102C, 102M, and 102Y properly close spaces near the discharge ports.

Recess portions of the caps 102C, 102M, and 102Y communicate with a drain ink absorbing member 143 via a tube, and the tube pump 142 is engaged therebetween. The tube pump 142 comprises a guide roller 140 rotated by an activating means (not shown) such as a motor, a compression roller 141 arranged on a portion of the guide roller, and a tube guide 144 for regulating the position of the tube. The compression roller 141 compresses the tube while sequentially changing its position by rotating in a counterclockwise direction about the guide roller 140, thereby forming a negative pressure in the recess portions of the caps 102C, 102M, and 102Y, and conveying absorbed ink in a direction of the drain ink absorbing member.

Figure 9:
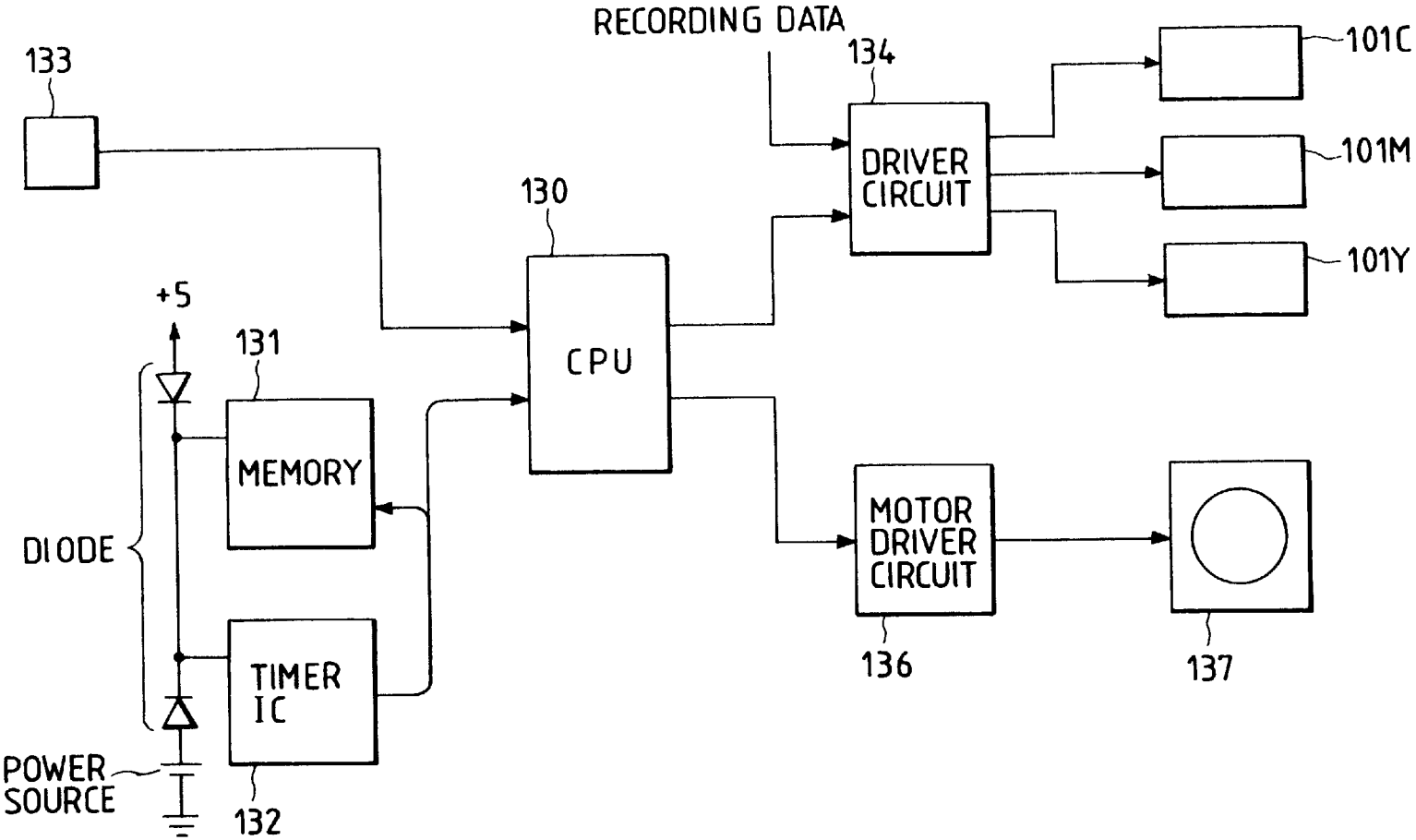
FIG. 9 is a block diagram showing an arrangement of a controller shown in FIG. 7.

In FIG. 9 is a block diagram showing a control arrangement of the ink jet recording apparatus shown in FIG. 7, the apparatus comprises a CPU 130 serving as a control unit for executing control processing associated with the processing operations of the entire apparatus, and a capping position sensor 133 for detecting the above-mentioned capping positions. The sensor 133 detects the movement of members having a fixed positional relationship with the caps, e.g., the cap holders. A timer IC 132 outputs a signal serving as a reference for time. A memory 131 has an area for storing time based on the signal output from the timer IC. For example, the CPU 130 resets the time data stored in the memory 131 on the basis of a detection signal from the sensor 133 or processing executed by itself. More specifically, the memory 131 stores a capping time of the discharge port surfaces of the head cartridges, and a time elapsed from the latest discharge operation. The memory 131 and the timer IC 132 are backed up by a power source different from that of the apparatus of this embodiment, and can count, e.g., the capping time while the power source of the apparatus is kept OFF.

A recording head driver circuit 134 activates or drives the recording head cartridges 101C, 101M, and 10Y on the basis of recording data from a host device, and a control signal from the CPU 130, thereby performing an ink discharge operation. A motor driver circuit 136 drives the guide roller 140 of the tube pump 142 on the basis of a control signal from the CPU 130.

Figure 10:
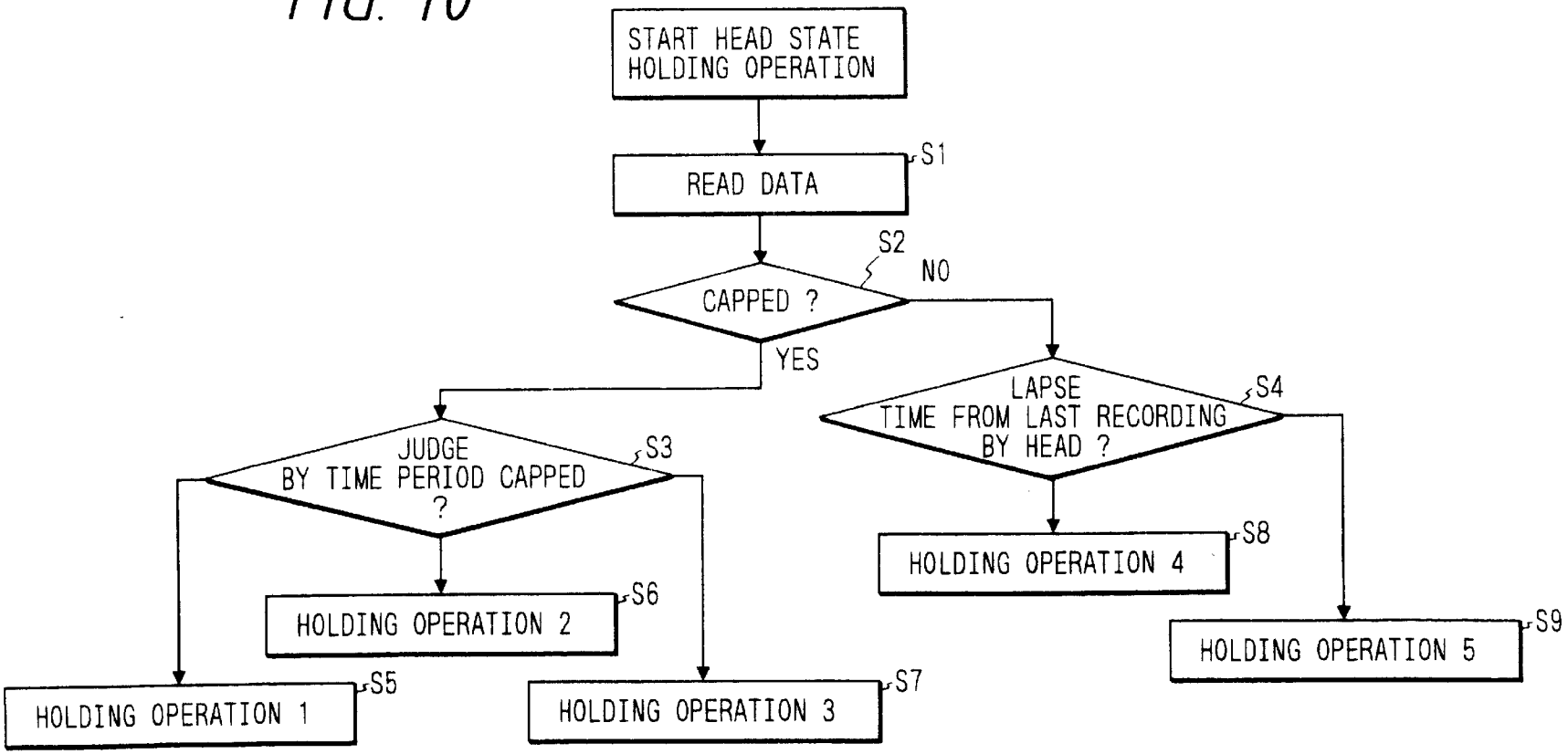
FIG. 10 is a flow chart showing a processing sequence of this embodiment.

FIG. 10 is a flow chart showing a processing sequence according to this embodiment. This processing is started automatically when the power source is turned on, or in response to an input instructing this processing by a user.

A head state holding operation to be described below means a discharge stabilization treatment including one of the capping, idle discharge, and ink absorbing (or compression) operations, or a combination thereof.

When this processing is started, data in the area of the memory 131 for storing, e.g., a capping time is read in step S1. The data stored in this area includes an elapse of time of a state wherein the heads are capped, and an elapse of time from the latest discharge operation of the recording heads (from the end of the latest discharge operation).

It is checked in step S2 if the heads are presently capped. If YES in step S2, the flow advances to step S3, and the head state holding operation to be performed is branched in accordance with the elapse of time in the capping state, which is read out in step S1. More specifically, if the elapse time of the capping state falls within a predetermined time period (e.g., 1 hour), a holding operation 1 for performing only an idle discharge operation is performed in step S5. If the elapse of time of the capping state falls within another predetermined time period (e.g., more than 1 hour and less than 24 hours), a holding operation 2 for performing an ink absorbing operation once, and the idle discharge operation is performed in step S6. If the elapse of time of the capping state exceeds the predetermined time period (e.g., 24 hours), a holding operation 3 for performing the ink absorbing operation twice and the idle discharge operation is performed in step S7.

If NO in step S2, i.e., if it is determined that the heads are not capped, the flow advances to step S4, a holding operation is determined in accordance with an elapse time from the latest discharge operation by the recording heads. More specifically, if the recording heads are left unoperated for less than 24 hours from the latest discharge operation, a holding operation 4 for performing the ink absorbing operation three times, and the idle discharge operation is performed in step S8. If the recording heads are unoperated for more than 24 hours, a holding operation 5 for performing the ink absorbing operation five times, and the idle discharge is performed in step S9.

The number of ink absorbing operations in the holding operations is not limited to those described above, and contents of the holding operations are not limited to the combinations described above. More specifically, as the contents of the holding operations, contents capable of minimizing ink consumption and time required for the corresponding holding operations, and capable of obtaining a satisfactory discharge recover effect should be appropriately determined in independent apparatuses. Therefore, the elapse periods are not limited to those described above, and may be arbitrarily set in accordance with characteristics of ink jet heads and apparatuses.

The elapsed times as references for branching the respective state holding operations are not limited to those described above. As will be described later with reference to FIG. 11 and FIGS. 12A and 12B, an elapse of time of an uncapping state may also be used, and an elapse of time from the latest absorbing operation may be used.

Figure 11:
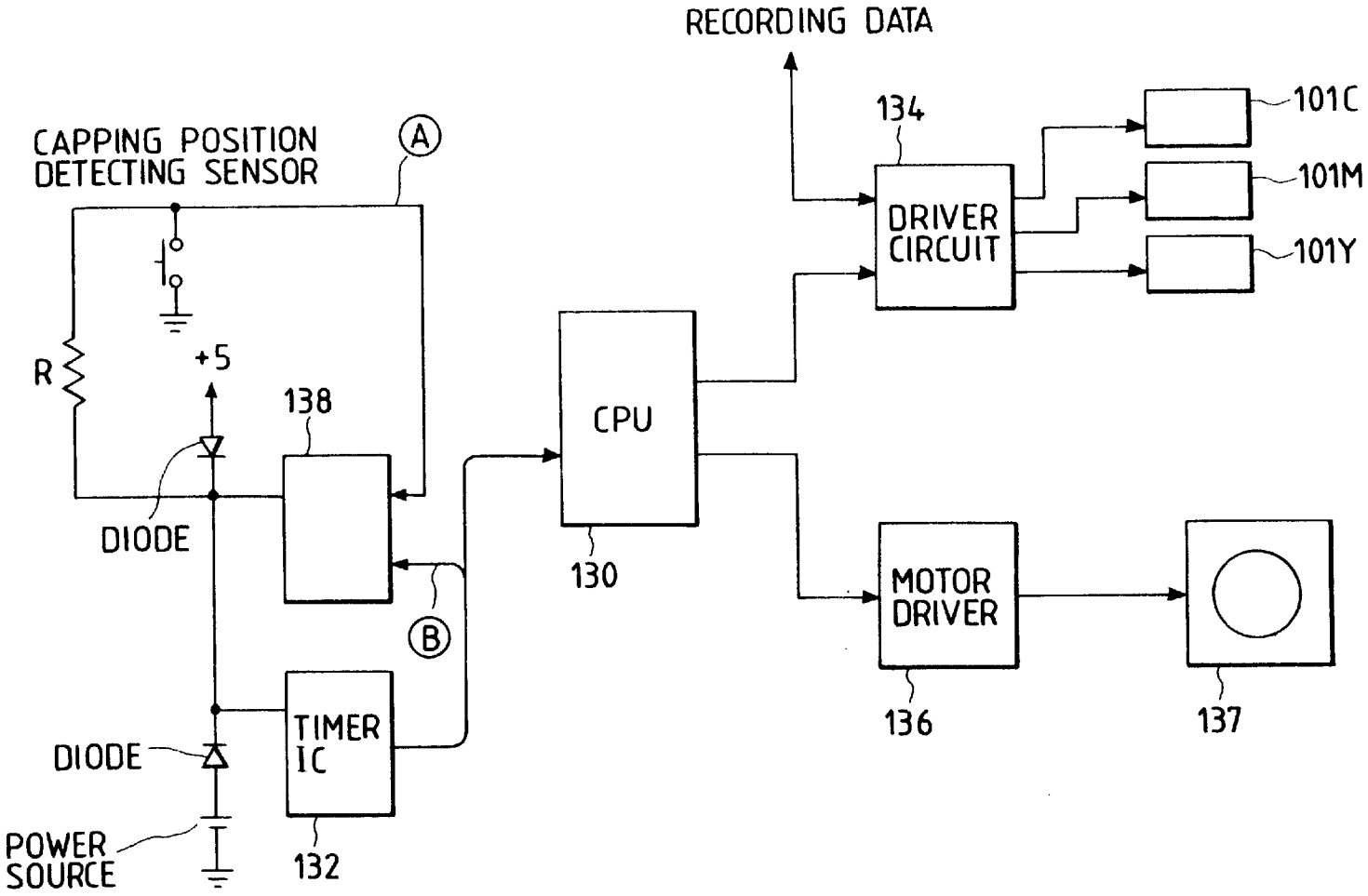
FIG. 11 is a block diagram showing a modification of the controller shown in FIG. 9.

FIG. 11 is a block diagram showing a modification of the control arrangement shown in FIG. 9.

The difference from the arrangement shown in FIG. 9 is that the capping position sensor is also backed up by a power source different from that of the apparatus. Thus, even when the recording head cartridges are displaced from their capping positions due to paper jam removing processing or a recording head chip exchange operation while the power source of the apparatus is kept OFF, a time during this interval can be counted, and processing shown in FIG. 10 can be more accurately executed.

Figure 12A:
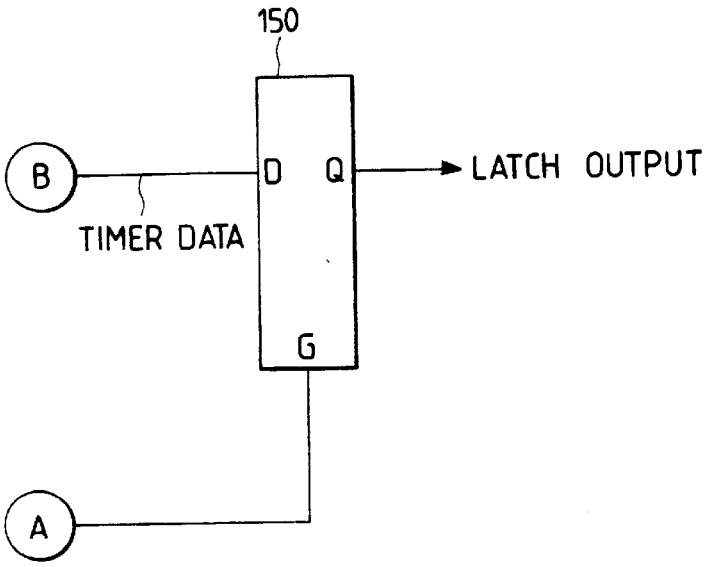
FIGS. 12A and 12B are respectively a block diagram and a timing chart of a latch IC shown in FIG. 11.
Figure 12B:
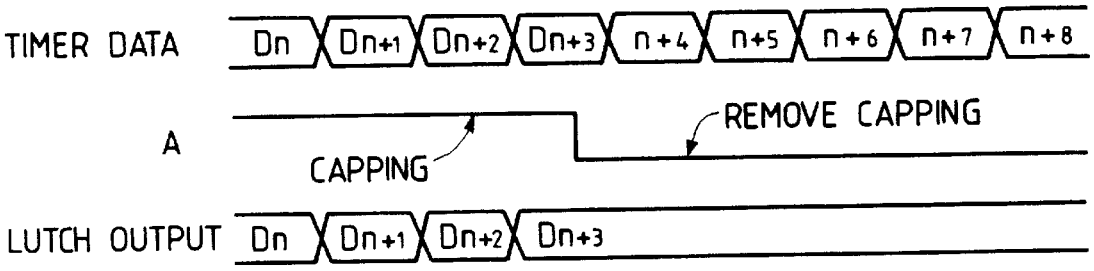

FIGS. 12A and 12B are respectively a block diagram showing in detail a latch IC 150 arranged in a memory and its peripheral circuit 138 shown in FIG. 11, and a timing chart of signals.

An output B from the timer IC 132 becomes a data input of the latch IC 150, and this input is gated by an output A from the sensor 133. As a result, as shown in FIG. 12B, time $D_{n+3}$ at which the heads are uncapped is latched, and is held. Thereafter, latched data is updated when the heads are capped again.

In this manner, a content of a discharge recover treatment consisting of idle discharge and ink discharge operations is selected in accordance with at least one of an elapse of time from the latest ink discharge or ink absorbing operation, and an elapse of time of a capping or uncapping state. The elapse of time can be held even when the power source of the ink jet recording apparatus is kept OFF. Therefore, a discharge state of the recording head in a non-use time of the apparatus can be administered.

As a result, an optimal recover treatment consisting of the ink absorbing and idle discharge operations can be performed. Thus, unnecessary ink consumption by the recover treatment can be reduced, and a decrease in recording speed can also be prevented.

Still another embodiment of the present invention will be described below with reference to the accompanying drawings.

Figure 13:
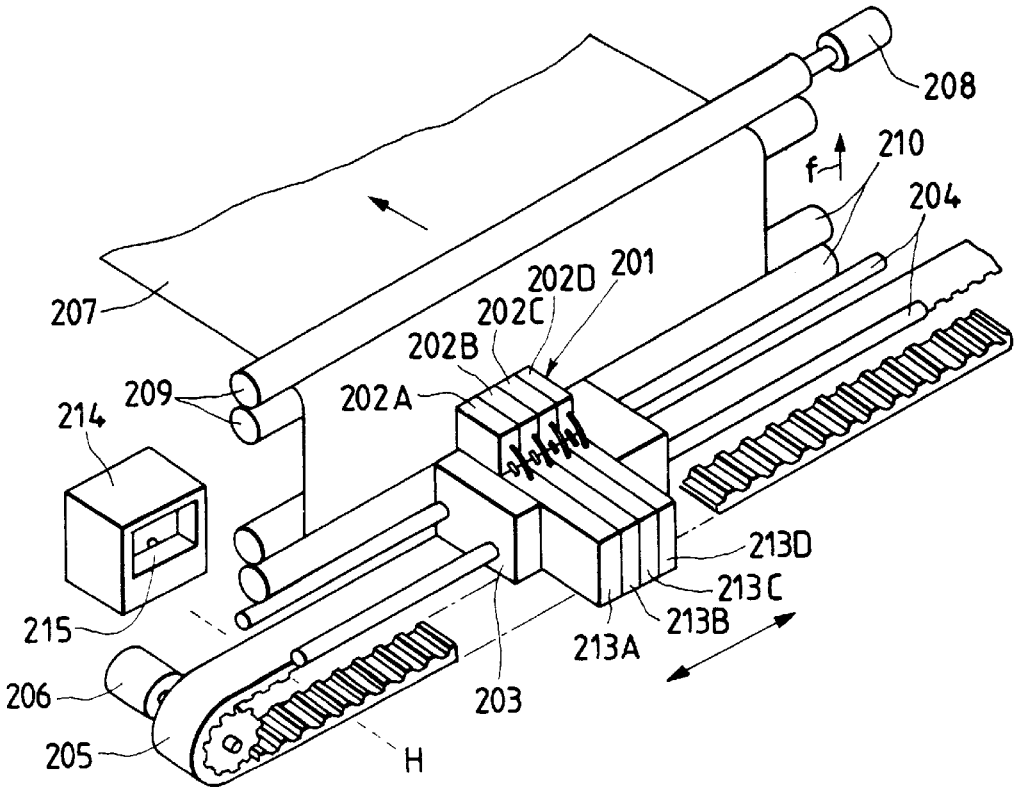
FIG. 13 is a perspective view showing an arrangement of main part of an ink jet recording apparatus according to still another embodiment of the present invention.

In FIG. 13 as a perspective view showing a main part of an ink jet recording apparatus according to still another embodiment of the present invention having a head unit 201 mounted on a carriage 203, and a plurality of (four in FIG. 13) recording heads 202A, 202B, 202C, and 202D.

Discharge ports (normally, a plurality of ports) are formed on the discharge port surfaces of the recording heads 202A to 202D, and the recording heads 202A to 202D discharge ink of different colors. For example, in a color ink jet recording apparatus, the recording heads 202A to 202D can correspond to ink colors of, e.g., yellow, magenta, cyan, and black.

Each of the recording heads 202A to 202D is an ink jet recording head for discharging ink by utilizing heat energy, and comprises electrothermal transducers for generating heat energy. Each of the recording heads 202A to 202D discharges ink from the discharge ports by growth of bubbles by film boiling caused by heat energy applied from the electrothermal transducers, thus performing recording.

Figure 15:
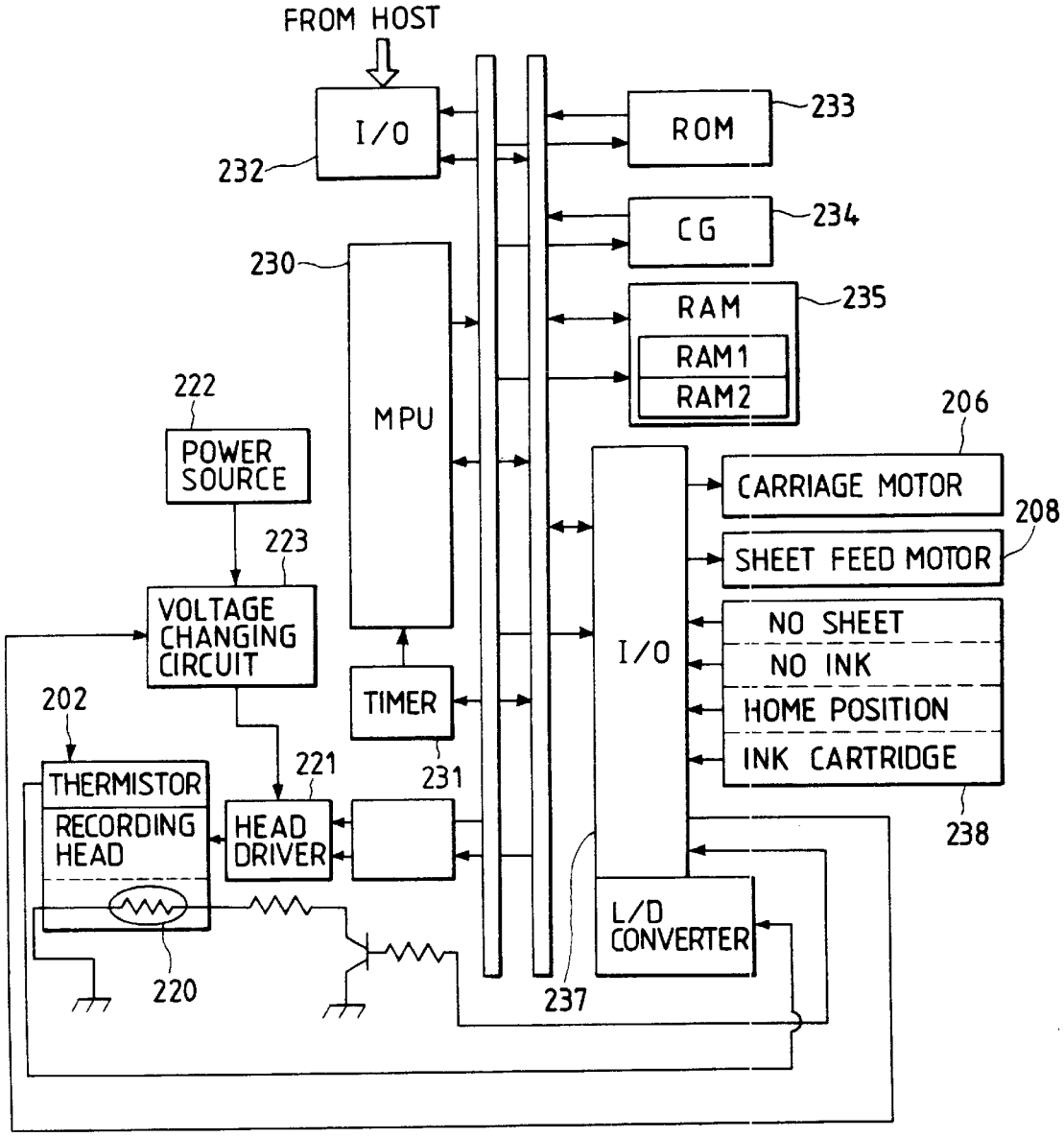
FIG. 15 is a block diagram showing an arrangement of a control system of the ink jet recording apparatus of this embodiment.

In a block diagram of a control system shown in FIG. 15, the carriage 203 which carries the head unit 201 is movably supported along guide rails 204, and is reciprocally driven by a carriage motor 206 via a timing belt 205.

A sheet-like recording medium 207 such as a paper sheet, a plastic thin plate, or the like is conveyed (fed) in a direction of an arrow f at a predetermined timing and a predetermined pitch along a predetermined path by a pair of convey rollers 209 driven by a convey motor (sheet feed motor) 208, and a pair of holding rollers 210 which are interlocked with the rollers 209. While the recording medium 207 is held flat at a recording position opposing the recording heads 202A to 202D, a recording operation is performed by main-scanning the recording heads 202A to 202D. Upon completion of the recording operation for one line, the recording medium 207 is fed by a predetermined pitch in the direction of the arrow f, and a recording operation for the next line is performed.

Note that ink tanks 213A to 213D for supplying ink of corresponding colors to the recording heads 202A to 202D are exchangeably mounted on the carriage 203.

A home position H is set at a predetermined position within a moving range of the carriage 203 and outside a recording region. A recovering device 214 for recovering discharge errors including an ink non-discharge state of the recording heads 202A to 202D is arranged at the home position H. The recovering device 214 has a cap 215 capable of closing the discharge port surfaces (surfaces where the discharge ports are formed) of the recording heads 202A to 202D.

Figure 14:
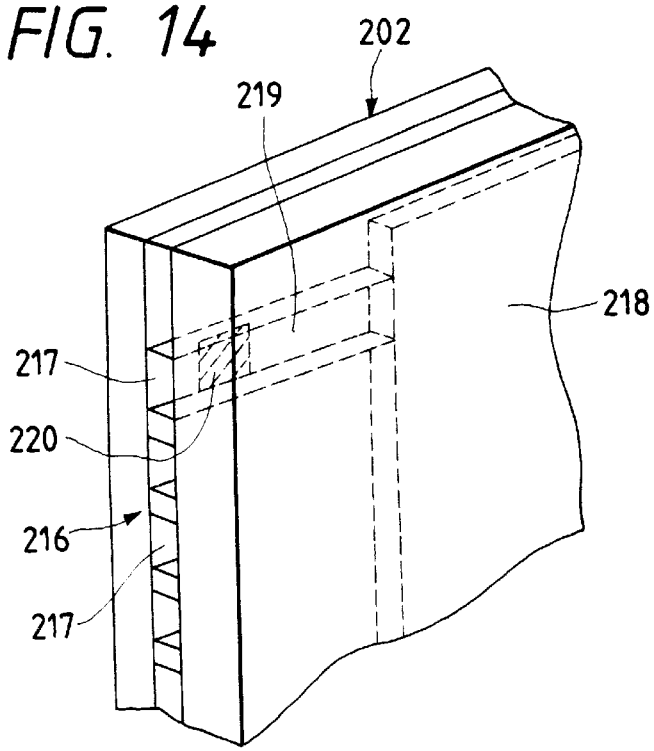
FIG. 14 is a partial perspective view showing a structure of a recording head shown in FIG. 13.

FIG. 14 is a partial perspective view of an ink discharge portion of the recording head 202 (an arbitrary one of the recording heads 202A to 202D) in FIG. 13. In FIG. 14, a plurality of discharge ports are formed on a discharge port surface 216 opposing the recording medium 207 at a predetermined gap (e.g., about 0.5 mm) at a predetermined pitch in the longitudinal direction, and electrothermal transducers (having heating resistors) 220 as heaters for discharging ink are arranged along wall surfaces of liquid paths 219 for causing a common liquid chamber 218 to communicate with discharge ports 217.

Desired heaters 220 are driven (energized) on the basis of an image signal (recording information) to generate bubbles in the ink in the liquid paths 219. Flying ink droplets are formed based on the bubbles, and the ink droplets (dots) become attached to the recording medium 207, thus recording an image. When a power switch is turned on, and in other necessary states, the recording heads 202A to 202D are moved to the position of the cap 215, and the heaters (normally, heaters of all the discharge ports) 220 are driven, thereby performing a preliminary discharge operation for discharging ink from the discharge ports 217 into the cap 215.

The preliminary discharge operation outside the recording region is mainly performed to eliminate discharge errors caused by sticking ink, viscosity-increased ink, dust such as paper pieces, or bubbles in the ink in the ink discharge portion (e.g., in the discharge ports 217 and the liquid paths 219) of the recording head 202.

In FIG. 15 as a block diagram showing an arrangement of the control system of the ink jet recording apparatus shown in FIG. 13, the heaters 220 of the recording head 202 are driven by a driver 221, and electrical power is supplied from a power source 222 to the driver 221 via a voltage changing circuit 223. An MPU 230 is connected to a timer 231, and can perform timer administration of the preliminary discharge operation.

In FIG. 15, the apparatus includes an I/O port 232 for receiving signals from a host device, a ROM 233 for storing, e.g., a control program, a character generator 234, and a RAM 235 for storing, e.g., image signals. The carriage motor 206 and the convey motor 208 are controlled by the MPU 230 via an I/O port 237.

Furthermore, the MPU 230 receives, via the I/O port 237, detection signals from sensors 238 for detecting the presence/absence of the recording medium 207, the presence/absence of an ink remaining amount, whether or not the carriage 203 is located at the home position H, the presence/absence of the ink cartridge (ink tank) 213, and the like.

In the ink jet recording apparatus for performing recording on the recording medium 207 by injecting ink from the recording heads 202, even when a predetermined time is selected in timer administration in the recording apparatus, and the number of ON times of the power source of the recording apparatus is large, in the setting time, a preliminary discharge operation for recovering discharge of the recording heads 202 is performed only a small number of times. In this case, the setting time can be set to be about 30 minutes, and the number of preliminary discharge operations in the setting time can be set to be one or two.

Furthermore, in the ink jet recording apparatus for discharging ink from the recording heads 202 to perform recording on the recording medium 207 according to this embodiment, a predetermined time is selected in timer administration in the recording apparatus, and the number of preliminary discharge activating pulses for recovering discharge of the recording heads 202 is decreased as the number of ON times of the power source of the recording apparatus is increased. In this case, the number of preliminary discharge activating pulses can be controlled to be sequentially decreased from an initial pulse count every time the power source is turned on.

Figure 16:
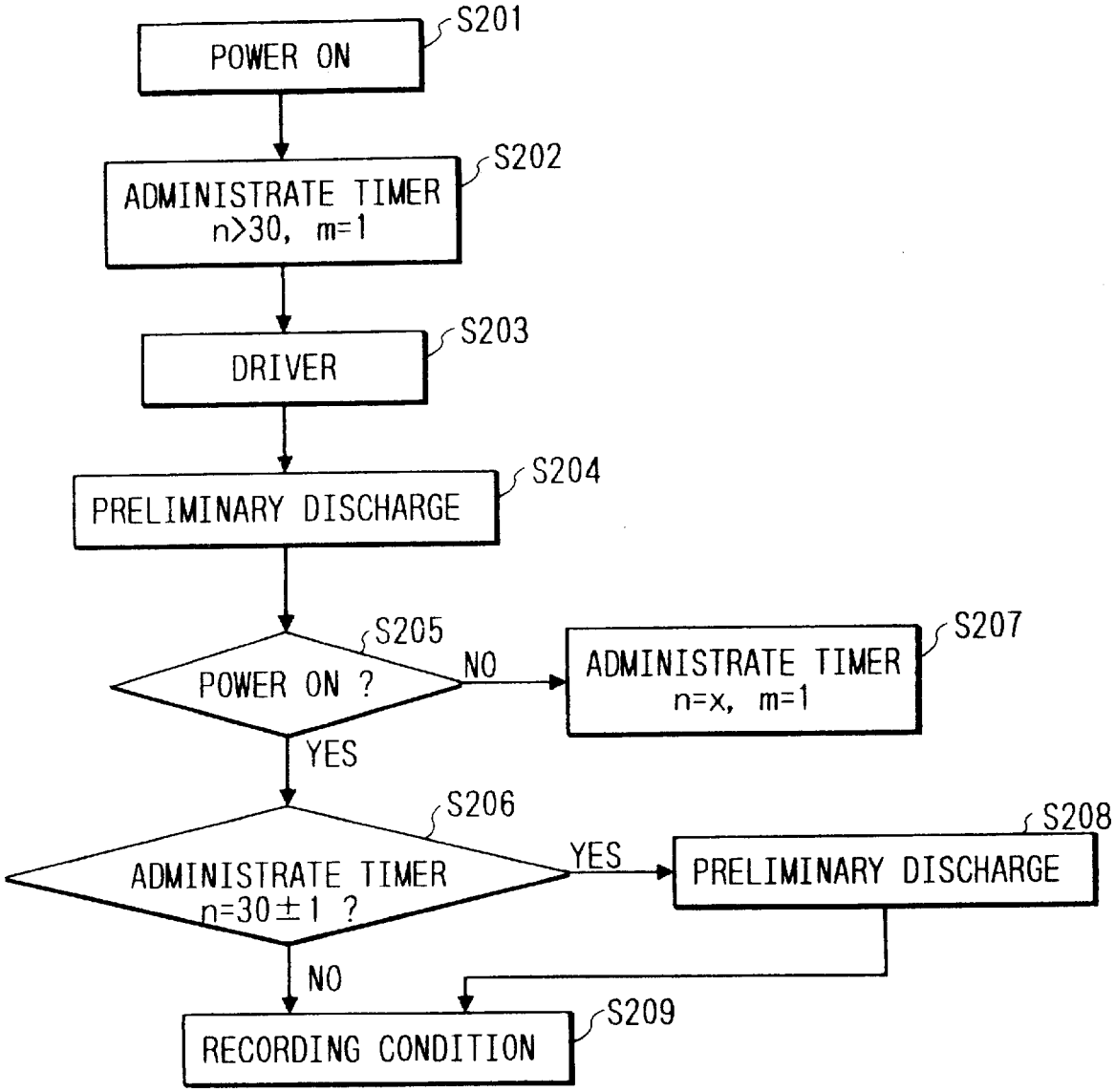
FIG. 16 is a flow chart showing a preliminary discharge sequence upon a first power-on operation in the ink jet recording apparatus of this embodiment.
Figure 17:
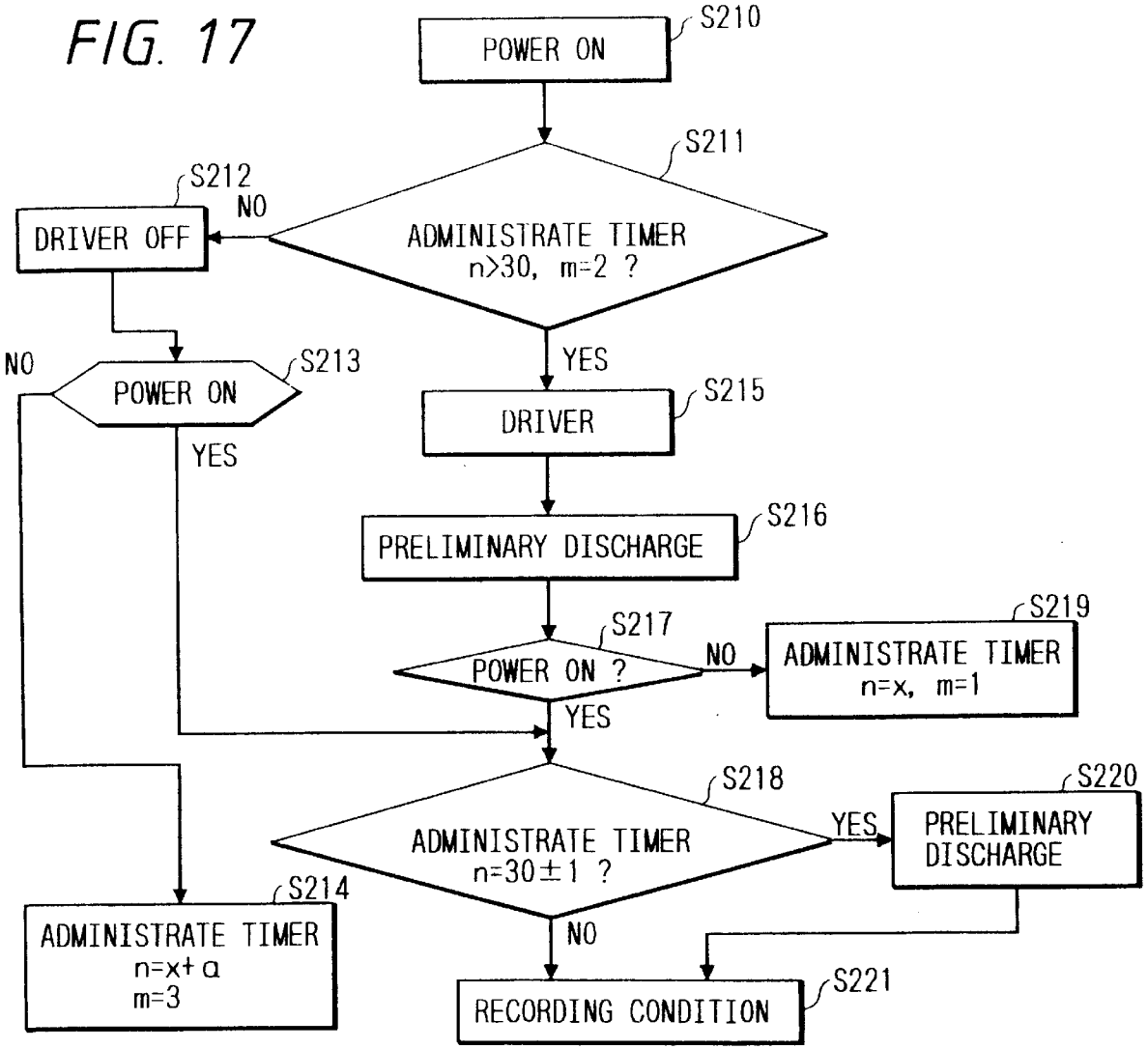
FIG. 17 is a flow chart showing a preliminary discharge sequence upon a second power-on operation in the embodiment shown in FIG. 16.

FIGS. 16 and 17 are flow charts of the preliminary discharge operation executed when the power source of the ink jet recording apparatus of this embodiment is turned on. FIG. 16 shows a sequence upon a first power-on operation, and FIG. 17 shows a sequence upon a second power-on operation. In this embodiment, the number of preliminary discharge operations is controlled to be decreased to a smaller number of times (including zero) in accordance with the number of ON times of the power source in a setting time.

In FIG. 16, after the power source is turned on for the first time in step S201, for example, a setting time n=30 minutes is set in the timer 231, and the number of ON times of the power source=1 is stored in step S202. In this case, since the power source is turned on before recording, the recording heads 202 are stopped at positions facing the cap 215 outside a recording region.

In step S203, the driver 221 is energized to activate the recording heads 202 (to heat ink), and in step S204, a preliminary discharge operation is performed into the cap 215.

In step S205, it is checked if the power source is kept ON. If Y (YES) in step S205, the flow advances to step S206 to check if the timer 231 reaches near an end of the setting time (a range of 30 minutes±1 minute of an elapsed time in this embodiment). On the other hand, if N (NO) in step S205, the flow advances to step S207, and the time n and the number of times m of ON times of the power source are sequentially stored in the timer 231 until the timer 231 reaches the setting time.

In step S207, an elapsed time to be stored is indicated by x, and since the number of ON times of the power source is 1, m=1 is stored. If Y in step S206, the preliminary discharge operation is performed once again in step S208, and the flow advances to step S209. Thus, the control enters a recording condition.

In this embodiment, since the number of preliminary discharge operations in the setting time is set to be 2, the second preliminary discharge operation is performed in step S208. However, if the number of preliminary discharge operations in the setting time is set to be 1, the preliminary discharge operation in step S208 is omitted. If the number of preliminary discharge operations in the setting time is set to be 3 or more, the preliminary discharge operation is performed in step S208 a number of times obtained by subtracting 1 from the setup number of times. If the power source is kept ON, and if it is determined in step S206 that the timer 231 has not reached the end of the setting time, the flow advances to step S209, and the control enters a recording condition.

If the second ON operation of the power source is detected after the first ON operation of the power source, an operation sequence shown in FIG. 17 is started. More specifically, after the power source is turned on for the second time in step S210, it is checked in step S211 if the timer 231 exceeds the setting time (30 minutes) in FIG. 16, and if the number of ON times m of the power source=2.

If the setting time (setting time n in step S202, i.e., 30 minutes) is not exceeded (within the setting time), the head driver 221 is turned off in step S212, and it is checked in step S213 if the power source is kept ON. If N in step S213, the flow advances to step S214, and the time n and the number of ON times m of the power source are sequentially stored in the timer 231 until the timer 231 reaches the setting time. In step S214, an elapse time is given by $n=x+\alpha$, and the number of ON times of the power source is m=3.

If it is determined in step S211 that the timer exceeds the setting time (30 minutes), the same operations as in steps S203 to S209 upon the first power-on operation in FIG. 16 are repeated. More specifically, in step S215, the driver 221 is energized to activate the recording heads 202 (to heat an ink), and in step S216, ink is discharged into the cap 215 (preliminary discharge operation). In step S217, it is checked if the power source is kept ON. If Y in step S217, the flow advances to step S218 to check if the timer 231 has reached near the end of the setting time (a range of 30 minutes±1 minute of an elapsed time in this embodiment).

On the other hand, if N in step S217, the flow advances to step S219, and the time n and the number of times m of ON times of the power source are sequentially stored in the timer 231 until the timer 231 reaches the setting time. In step S219, an elapse of time to be stored is indicated by x, and the number m of ON times is stored as 1 since the setting time is exceeded. If it is determined in step S218 that the timer 231 has reached near the end of the setting time (30 minutes±1 minute), the preliminary discharge operation is performed once again in step S220, and the flow advances to step S221. Thus, the control enters a recording condition.

In this embodiment, since the number of preliminary discharge operations in the setting time is set to be 2, the second preliminary discharge operation is performed in step S220. However, if the number of preliminary discharge operations in the setting time is set to be 1, the preliminary discharge operation in step S220 is omitted. If the number of preliminary discharge operations in the setting time is set to be 3 or more, the preliminary discharge operation is performed in step S220 a number of times obtained by subtracting 1 from the setup number of times.

If the power source is kept ON, and if it is determined in step S218 that the timer 231 has not reached near the end of the setting time, the flow advances to step S221, and the control enters a recording condition.

If it is determined in step S213 that the power source is kept ON, the flow advances to step S218 to check if the timer 231 has reached near the end of the setting time (a range of 30 minutes±1 minute of an elapse time in this embodiment). If Y in step S218, the preliminary discharge operation is executed once again in step S220 like in the above-mentioned sequence, and thereafter, the control enters the recording condition in step S221; if N in step S218, the flow directly advances to step S221, and the control enters the recording condition. Thereafter, if the third and subsequent ON operations of the power source are detected, the same operations as upon the second power-on operation described above are repeated.

Figure 18:
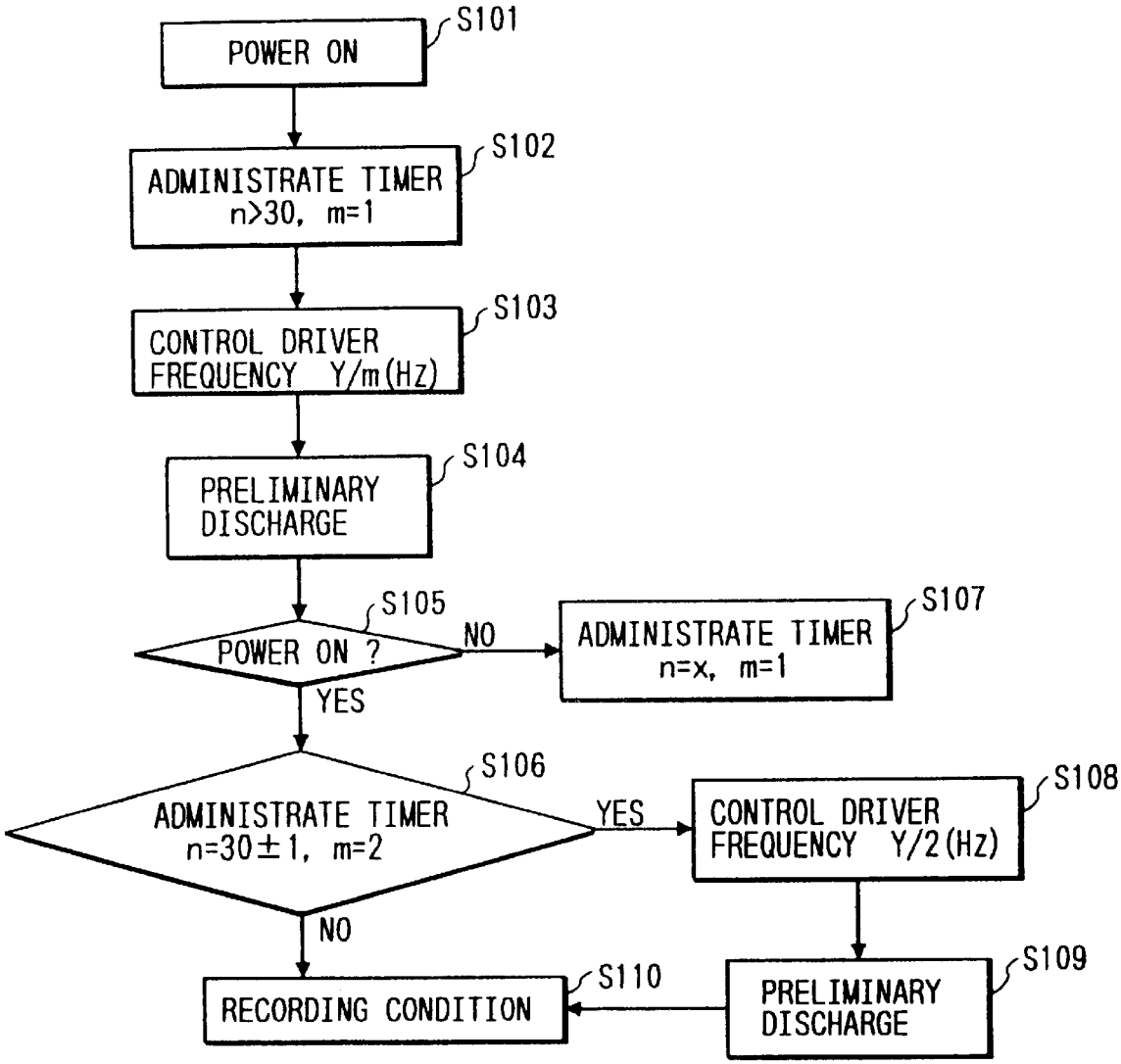
FIG. 18 is a flow chart showing a preliminary discharge sequence upon a first power-on operation according to still another embodiment of an ink jet recording apparatus.
Figure 19:
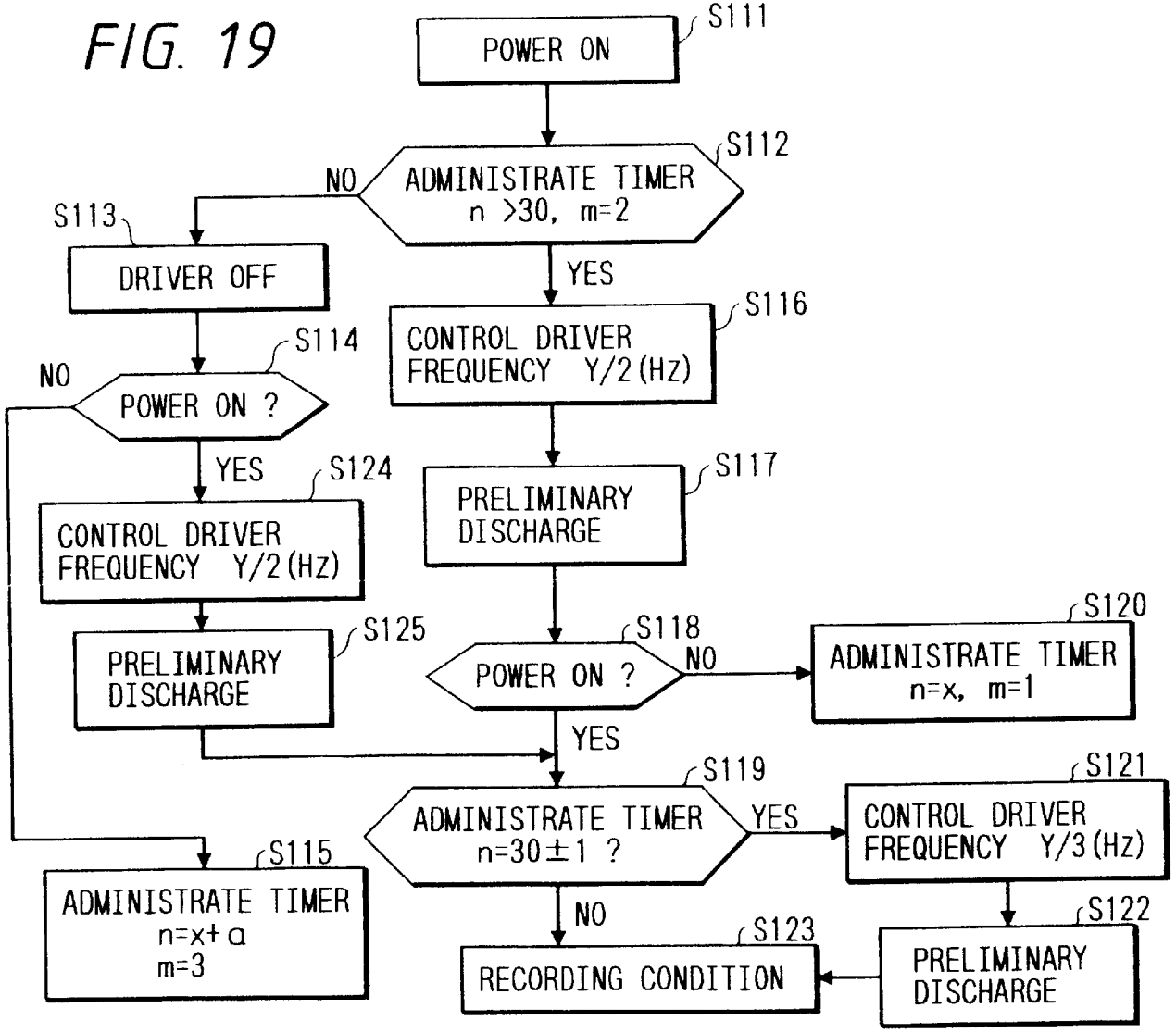
FIG. 19 is a flow chart showing a preliminary discharge sequence upon a second power-on operation in the embodiment shown in FIG. 18.

FIGS. 18 and 19 are flow charts of a preliminary discharge operation of an ink jet recording apparatus upon a power-operation according to another embodiment. FIG. 18 shows a sequence upon a first power-on operation, and FIG. 19 shows a sequence upon a second power-on operation. In this embodiment, the number y of preliminary discharge activating pulses upon a power-on operation is controlled.

In FIG. 18, after the power source is turned on for the first time in step S101, for example, a setting time n=30 minutes is set in the timer 231, and the number of ON times of the power source=1 is stored in step S102. In this case, since the power source is turned on before recording, the recording heads 202 are stopped at positions facing the cap 215 outside a recording region.

In step S103, the frequency of the head driver 221 is controlled, and in step S104, the recording heads 202 are activated (i.e., the heaters 220 are energized) a number of times corresponding to the frequency (number of pulses), and the preliminary discharge operation is performed by the setting number of activating pulses. In this case, the initial number of activating pulses is set to be, e.g., y=30 Hz. Since the number of ON times m of the power source is 1, an ink droplet discharge operation of y/m=30 times (Hz) is set.

It is then checked in step S105 if the power source is kept ON.

If Y in step S105, the flow advances to step S106 to check if the timer 231 has reached near the end of the setting time (a range of 30 minutes±1 minute of an elapsed time in this embodiment), and to confirm if the power source is turned on for the second time.

If N in step S105, the flow advances to step S107, and the time n and the number of times m of ON times of the power source are sequentially stored in the timer 231 until the timer 231 reaches the setting time. In step S107, an elapsed time to be stored is indicated by x, and since the number of ON times of the power source is 1, m=1 is stored.

If it is determined in step S106 that the timer 231 has reached near the end of the setting time (30 minutes±1 minute), the flow advances to step S108 to perform frequency control of the head driver 221. In this case, since the number of ON times m of the power source is 2, the number of preliminary discharge activating pulses of the recording heads 202 is set to be y/m=30/2=15 pulses (times).

In step S109, the preliminary discharge operation is performed once again by this setting number of pulses (15 times). Thereafter, the flow advances to step S110, and the control enters a recording condition.

In this embodiment, the number of preliminary discharge activating pulses within the setting time is sequentially decreased in accordance with the number of ON times of the power source.

If the power source is kept ON, and if it is determined in step S106 that the timer 231 has reached near the end of the setting time, the flow advances to step S110, and the control enters the recording condition.

If the second ON operation of the power source is detected after the first ON operation of the power source, an operation sequence shown in FIG. 19 is started. More specifically, after the power source is turned on for the second time in step S111, it is checked in step S112 if the timer 231 exceeds the setting time n=30 minutes set upon the first power-on operation, and if the number of ON times m of the power source is 2.

If it is determined that the timer does not exceed the setting time (within the setting time), the head driver 221 is turned off in step S113, and it is checked in step S114 if the power source is kept ON. If Y in step S114, the flow advances to step S115, and the time n and the number of times m of ON times of the power source are sequentially stored in the timer 231 until the timer 231 reaches the setting time.

In step S115, an elapsed time $n=x+\alpha$, and the number of ON times m=3 of the power source are stored.

If it is determined in step S112 that the timer exceeds the setting time (30 minutes), substantially the same operations as in steps S103 to S109 upon the first power-on operation in FIG. 18 are performed, except that the number of ON times m of the power source is larger by one, and hence, the frequencies in steps S103 and S108 are decreased accordingly to execute the preliminary operations by the smaller number of activating pulses.

More specifically, the frequency of the head driver 221 is controlled in step S116, and the recording heads 202 are activated (the heaters 220 are energized) a number of times corresponding to the frequency (number of pulses) in step S117, thus performing the preliminary discharge operation by the setting number of activating pulses. In this case, the initial number of activating pulses is set to be y=30 Hz, and since the number of ON times m of the power source is 2, an ink droplet discharge operation of y/m=30/2=15 times (Hz) is set, thus performing the preliminary discharge operation.

It is then checked in step S118 if the power source is kept ON.

If Y in step S118, the flow advances to step S119 to check if the timer 231 has reached near an end of the setting time (a range of 30 minutes±1 minute of an elapse time in this embodiment), and to confirm if the power source is turned on for the third time.

If N in step S118, the flow advances to step S120, and the time n and the number of times m of ON times of the power source are sequentially stored in the timer 231 until the timer 231 reaches the setting time. In step S120, an elapsed time x and the number of ON times m=1 of the power source are stored.

If it is determined in step S119 that the timer 231 has reached near the end of the setting time (30 minutes±1 minute), the flow advances to step S121 to perform frequency control of the head driver 221. In this case, since the number of ON times m of the power source is 3, the number of preliminary discharge activating pulses of the recording heads 202 is set to be y/m=30/3=10 pulses (times).

In step S122, the preliminary discharge operation is performed once again by this setting number of pulses (10 times). Thereafter, the flow advances to step S123, and the control enters the recording condition.

If the power source is kept ON, and if it is determined in step S119 that the timer 231 has reached near the end of the setting time, the flow advances to step S123, and the control enters the recording condition.

If it is determined in step S114 that the power source is kept ON, the frequency of the head driver 221 is controlled in step S124, and the recording heads 202 are activated (the heaters 220 are energized) a number of times corresponding to the frequency (number of pulses) in step S125, thus executing the preliminary discharge operation by the setting number of activating pulses. In this case, the initial number of activating pulses is set to be y=30 Hz, and since the number of ON times m of the power source is 2 in step S124, an ink droplet discharge operation of y/m=30/2=15 times (Hz) is set. In step S125, the preliminary discharge operation is performed 15 times (for 15 pulses).

After the preliminary discharge operations in steps S124 and S125 are performed, the flow advances to step S119 described above, and the same operation as described above is performed.

In this manner, in the second power-on sequence (FIG. 19), if this operation is performed within the setting time, the preliminary discharge operation is performed by a smaller number of activating pulses than that upon the first power-on operation (FIG. 18).

Thereafter, if the third and subsequent power-on operations are performed within the setting time, the preliminary discharge operations are performed by the numbers of pulses which are decreased in accordance with an increase in the number of ON times m of the power source in the same sequence as that upon the second power-on operation (FIG. 19).

According to the embodiment described above, when the power source is repetitively turned on within a predetermined period of time, necessary preliminary discharge operations can be performed without performing unnecessary preliminary discharge operations. Therefore, an ink jet recording apparatus which can suppress wasteful ink discharge (ink consumption) can be obtained.

In the above embodiment, the present invention is applied to a serial-scan type ink jet recording apparatus in which the recording heads 202 are mounted on the carriage 203. However, the present invention can be similarly applied to other ink jet recording apparatuses, e.g., an ink jet recording apparatus which employs a line type recording head which can cover a recording region in the widthwise direction of a recording medium, and the same effects as described above can be attained.

In the above embodiment, a color ink jet recording apparatus using the four recording heads 202 has been exemplified. However, the present invention can be applied to a monochrome recording ink jet recording apparatus using a single recording head, a gradation recording ink jet recording head using a plurality of recording heads having the same color but different densities, and the like, regardless of the number of recording heads, and the same effects as described above can be attained.

As can be seen from the above description, in an ink jet recording apparatus for discharging an ink from recording heads to perform recording on a recording medium, a predetermined time is set in timer administration in the recording apparatus, and even when the number of ON times of the power source of the recording apparatus is large, preliminary discharge operations for recovering discharge of the recording heads are performed a small number of times within the setting time. Therefore, when the power source of the recording apparatus is repetitively turned on a large number of times (frequently), the ink amount consumed by the preliminary discharge operations can be controlled to fall within a necessary range. As a result, an ink jet recording apparatus which can eliminate wasteful consumption of an ink can be provided.

In an ink jet recording apparatus for discharging ink from recording heads to perform recording on a recording medium, a predetermined time is set in timer administration in the recording apparatus, and the number of activating pulses for preliminary discharge operations for recovering discharge of the recording heads is decreased in accordance with an increase in the number of ON times of the power source of the recording apparatus within the setting time. Therefore, when the power source of the recording apparatus is repetitively turned on a large number of times (frequently), the ink amount consumed by the preliminary discharge operations can be controlled to fall within a necessary range. As a result, an ink jet recording apparatus which can eliminate wasteful consumption of an ink can be provided.

Figure 20:
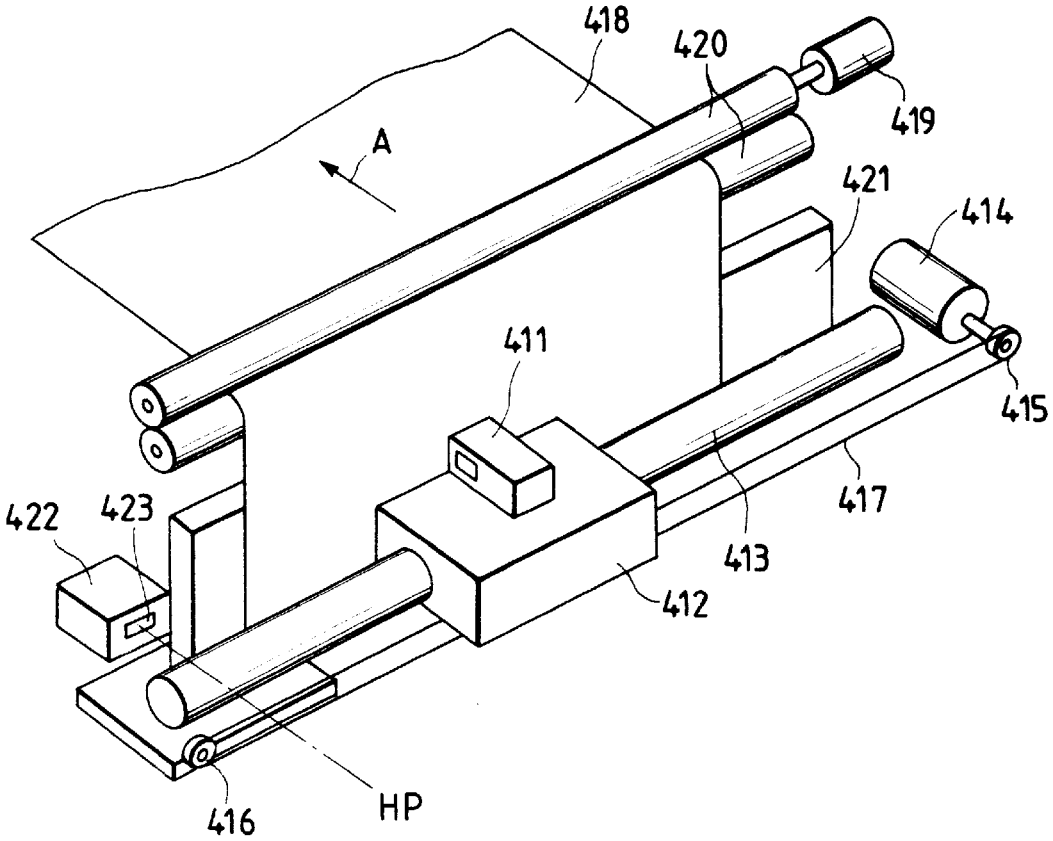
FIG. 20 is a perspective view of an ink jet recording apparatus according to still another embodiment of the present invention.

Still another embodiment of the present invention will be described below with reference to the accompanying drawings. FIG. 20 is a perspective view of an ink jet recording apparatus according to this embodiment.

In FIG. 20, a recording means (recording head) 411 is mounted on a carriage 412. The carriage 412 is movably guided along a guide shaft 413, and is reciprocally moved by a carriage motor 414 via pulleys 415 and 416, and a timing belt 417 looped between these pulleys. A sheet-like recording medium 418.such as a paper sheet, a plastic thin plate, or the like is conveyed (fed) in a direction of an arrow A at a predetermined timing and a predetermined pitch along a predetermined path by convey rollers (including a pair of rollers) 420 activated by a convey motor (sheet convey or feed motor) 419. The guide shaft 413 is parallel to the convey rollers 420.

The rear surface of the recording medium 418 is supported by a platen 421 on a recording region opposing the recording means, so that the recording medium can oppose the recording means 411 at a predetermined interval (e.g., 0.3 to 1.5 mm). When the carriage 412 is moved along the recording medium 418, and ink is discharged from discharge ports (normally, a plurality of discharge ports) of the recording means 411 on the basis of image information, a recording operation for one line is performed on the recording medium 418. Upon completion of the recording operation for one line, the recording medium 418 is fed at the predetermined pitch in the direction of the arrow A, thus starting the recording operation for the next line.

A home position HP is set at a predetermined position within a moving range of the carriage 412 and outside the recording region. A recovering unit 422 for performing a recover operation for recovering a discharge error caused by clogging of ink sticking to, e.g., an ink discharge portion (discharge ports) of the recording means 411, is arranged at the home position HP. A cap 423 which is in tight contact with a discharge port surface of the recording means 411 and covers and closes the discharge ports when the recording means reaches the home position is arranged on the front surface of the recovering unit 422. The recovering unit 422 comprises a suction pump (not shown). When no recording operation is performed for a predetermined period of time, the carriage 412 is moved to the home position HP, and the recovering unit 422 is moved forward, so that the discharge port surface is closed by the cap 423. In this state, the suction pump is operated to draw ink from the discharge ports by suction, thus executing the recover operation.

The recording means (recording head) 411 comprises electrothermal transducers for generating heat energy utilized to discharge an ink. The recording means 411 discharges ink from its discharge ports on the basis of growth and shrinkage of bubbles by film boiling caused by heat energy applied from the electrothermal transducers, thereby performing recording.

Figure 21:
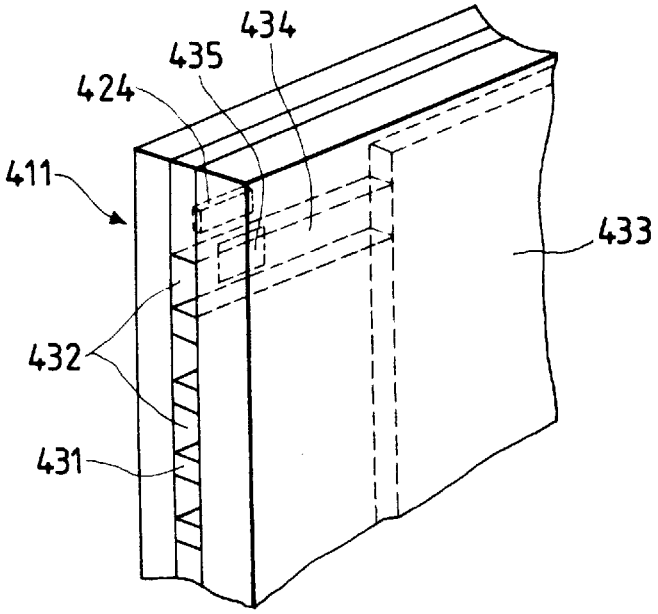
FIG. 21 is a partial perspective view showing a structure of an ink discharge unit of a recording means shown in FIG. 20.

FIG. 21 is a partial perspective view showing a structure of the ink discharge portion of the recording means (recording head) 411.

In FIG. 21, a plurality of discharge ports 432 are formed in a discharge port surface 431 opposing the recording medium 418 at predetermined intervals (e.g., about 0.5 to 2.0 mm), and electrothermal transducers (having heating resistors) 435 for generating energy utilized to discharge ink are arranged along wall surfaces of liquid paths 434 for causing a common liquid chamber 433 to communicate with the respective discharge ports 432. In the ink jet recording apparatus shown in FIG. 20, the recording means (recording head) 411 is mounted on the carriage 412 to have a positional relationship in that the discharge ports 432 are aligned in a direction perpendicular to the scanning direction (moving direction) of the carriage 412. In this manner, the recording means (recording head) 411 is arranged, so that desired electrothermal transducers 435 are activated (energized) on the basis of an image signal or a discharge signal, ink in the liquid paths 434 is film-boiled, and the ink is discharged from the discharge ports 432 based on the film boiling.

In FIGS. 20 and 21, the recording means 411 comprises an atmosphere temperature sensor 424 such as a thermistor for detecting a temperature of the recording means. In a power-off state of this ink jet recording apparatus, a time from a previous power-on operation is measured, and a temperature near the recording means is detected at predetermined time intervals, so that a power-on recover operation of the recording means is varied depending on the detected temperatures.

Figure 22:
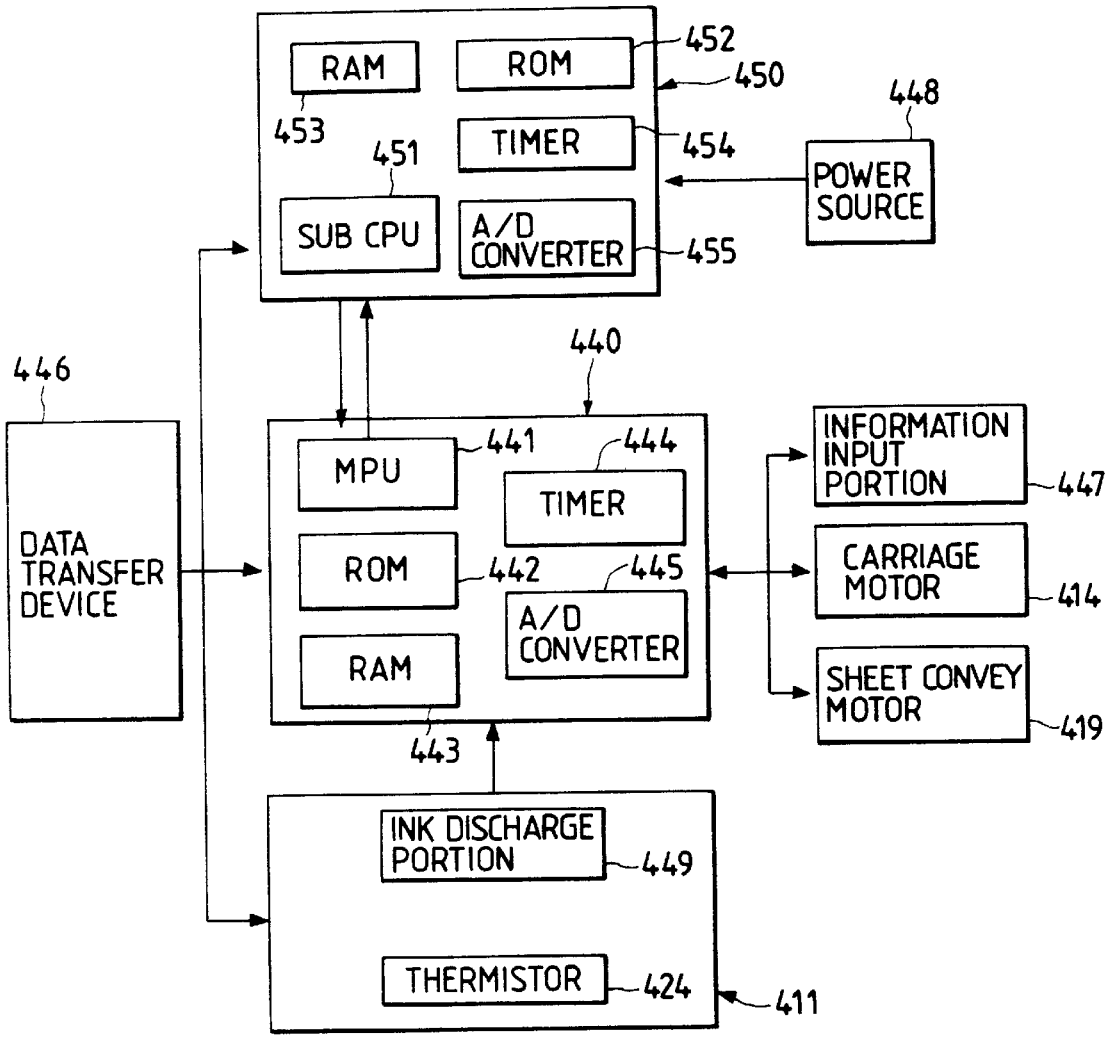
FIG. 22 is a block diagram showing an arrangement of a control system of the ink jet recording apparatus of this embodiment.

FIG. 22 is a block diagram showing an arrangement of a control system of the ink jet recording apparatus according to this embodiment.

In FIG. 22, a control unit 440 for controlling the entire recording apparatus comprises a microprocessor 441, a ROM 442, a RAM 443, a timer 444, and an A/D converter 445. The ROM 442 stores, e.g, data necessary for control operations of the recording apparatus and programs. The RAM 443 holds, e.g., data to be temporarily stored such as detection temperatures of the recording means 411, the number of times of recover operations upon a power-on operation, and the like. The timer 444 measures a time in accordance with an instruction from the microprocessor 441, and when a designated time elapses, the timer 444 outputs an interrupt signal to the microprocessor 441. The A/D converter 445 converts a voltage value, e.g., a detection temperature of the recording means 411, from an analog input to a digital output.

In FIG. 22, the control system includes a data transfer device 446 for transferring recording data to the control unit at a clock rate of a predetermined frequency in response to a trigger signal from the control unit 440, and an information input portion 447 for outputting information from, e.g., various sensors to the control unit 440. The operations of the carriage motor 414 and the convey motor (line feed motor) 419 are controlled by the control unit 440. Note that the carriage motor 414 and the convey motor 419 include drivers for activating these motors.

In FIG. 22, the control system also includes a power-off control unit 450 according to the present invention which is operated by power received from a power source 448. The power-off control unit 450 comprises a sub CPU (microprocessor) 451, a ROM 452, a RAM 453, a timer 454, and an A/D converter 455. The ROM 452 stores, e.g, data necessary for control operations of the recording apparatus and programs. The RAM 453 holds, e.g., data to be temporarily stored such as detection temperatures of the recording means 411, the number of times of recover operations upon a power-on operation, and the like. The timer 454 measures a time in accordance with an instruction from the sub CPU 451, and when a designated time elapses, the timer 454 outputs an interrupt signal to the sub CPU 451. The A/D converter 455 converts a voltage value, e.g., a detection temperature of the recording means 411 from an analog input to a digital output. A power source 448 of this power-off control unit is a backup type power source including an exchangeable battery type power source.

Referring to FIG. 22, the temperature sensor 424 for detecting an atmosphere temperature is arranged near an ink discharge portion 449 (FIG. 21) of the recording means 411. Detection temperature data from the temperature sensor 424 is supplied to both the control unit 440 for the entire recording apparatus, and the power-off control unit 450.

A control operation in a power-off state of the ink jet recording apparatus will be described below.

When the power source is turned off, the sub CPU 451 and the temperature sensor 424 measure a temperature near the recording head 411, and stores the measured value as data of 0 minute from the beginning of measurement in the RAM 453. The timer 454 measures a time with reference to this storage timing, and the sub CPU 451 and the temperature sensor 424 sequentially measure temperatures near the recording means 411 at 1-minute intervals. In this case, the detected temperatures are compared with a standard temperature (e.g., 15° C.), and parameters such as the number of times of detection of temperatures below the standard temperature, the number of continuous temperatures below the standard temperature, and the like are stored in the RAM 453.

For example, when 30 minutes going back from a given power-on operation are defined as one cycle, and control is made based on temperature measurement data during this interval, temperatures during a first extra period are sequentially erased from the RAM 453 when 30 minutes elapses. In this manner, when the power source is turned on again, a recovery operation is controlled with reference to temperature measurement data for 30 minutes before the power-on operation. If a time interval between the power-off operation and the power-on operation is equal to or less than 30 minutes, no data are erased, and control is made using all the temperature measurement data during this interval as standard data.

Figure 23:
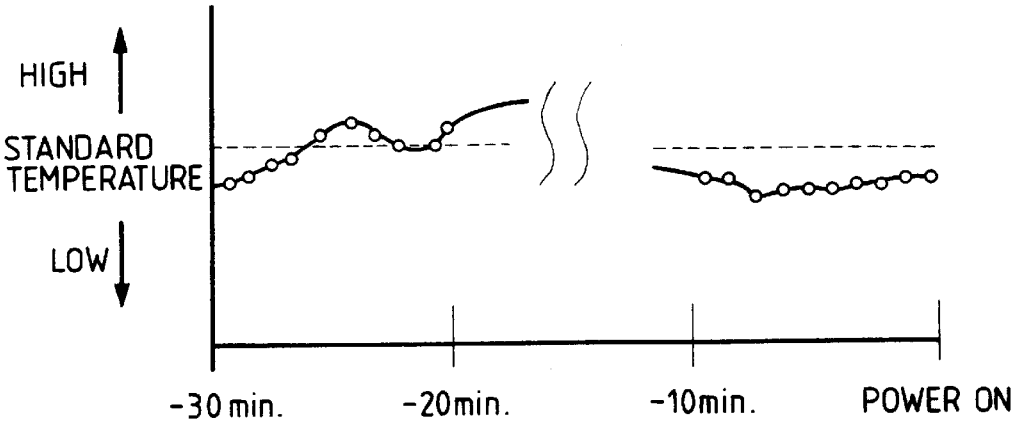
FIG. 23 is a graph for exemplifying a temperature near the recording means measured by the control system shown in FIG. 22 in a power-off state of the recording apparatus.
Figure 25:
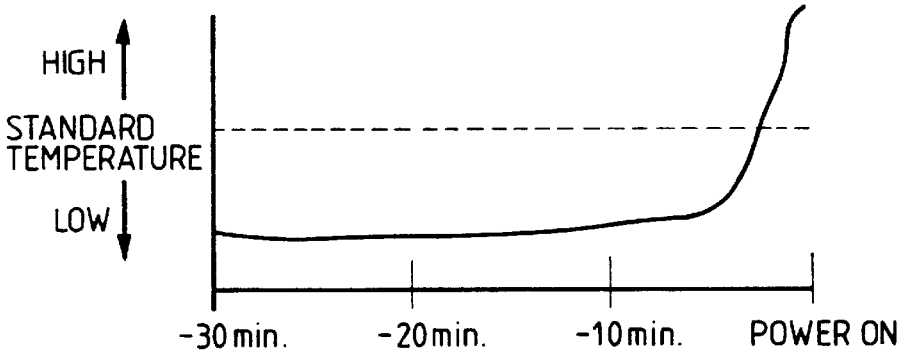
FIG. 25 is a graph showing a change in temperature near the recording means in a power-off state in the ink jet recording apparatus.
Figure 26:
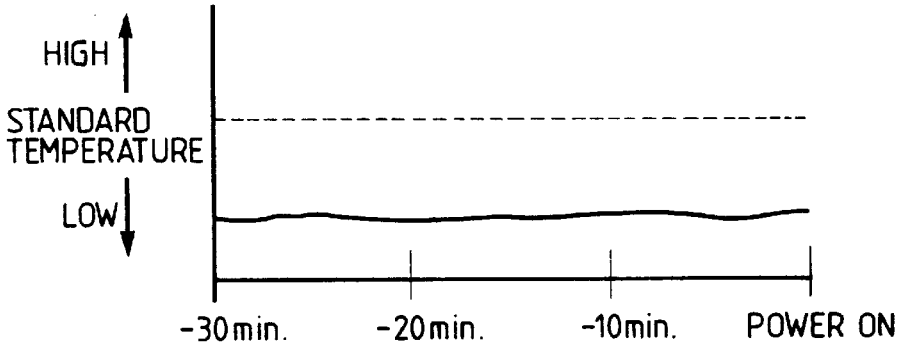
FIG. 26 is a graph showing another change in temperature near the recording means in a power-off state of the ink jet recording apparatus.

FIG. 23 is a graph for exemplifying the temperature measurement data in the power-off state. FIG. 23 shows data for 30 minutes (−30 minutes to the power-on operation) before a power-on operation. The "standard temperature" is a temperature below which ink begins to stick to the discharge ports, and is set to be, e.g., about 15° C.

Figure 24:
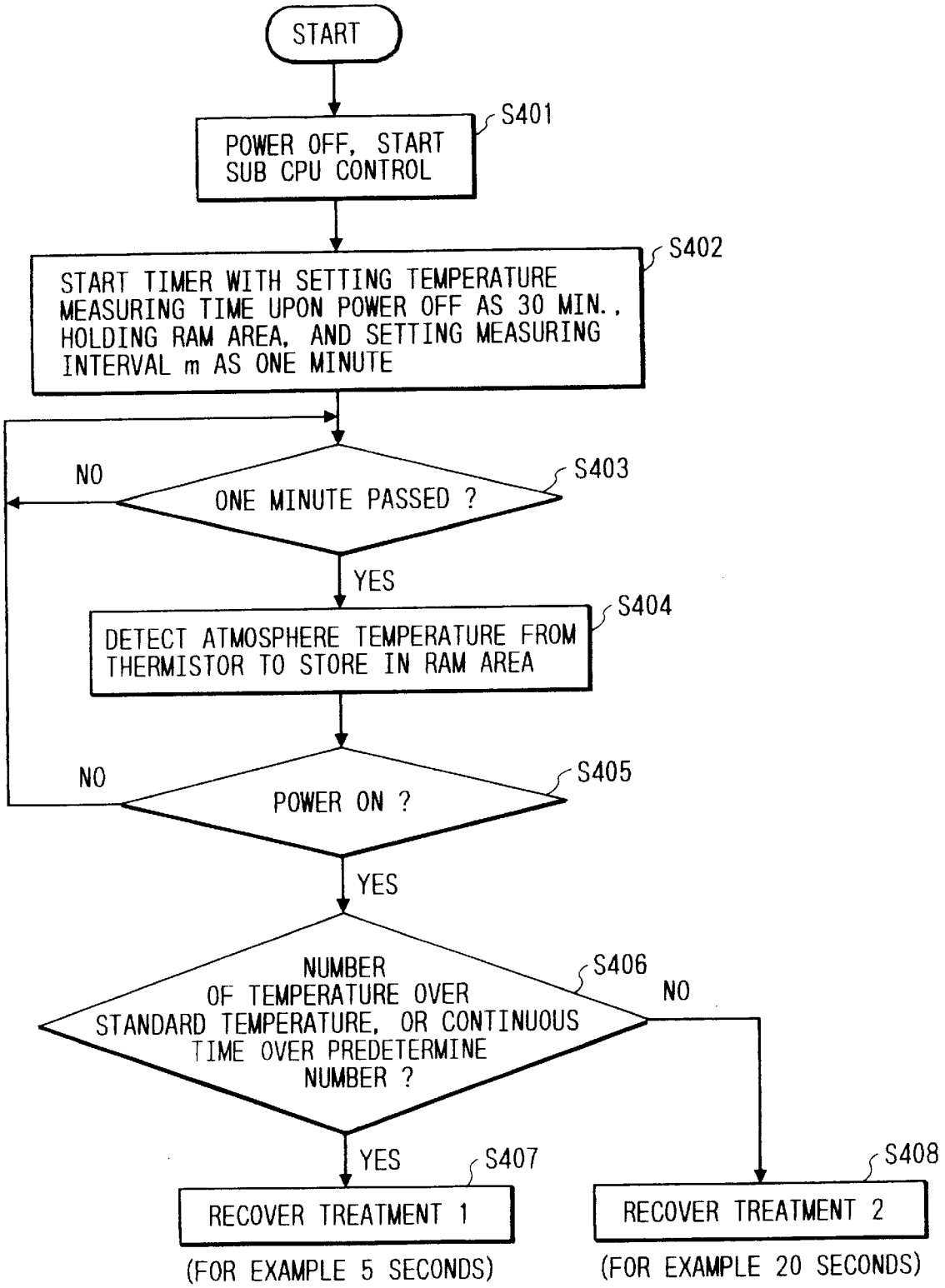
FIG. 24 is a flow chart showing an operation of the control system shown in FIG. 22.

FIG. 24 is a flow chart showing a sequence of a recover operation in the ink jet recording apparatus according to this embodiment. The recover operation of this embodiment will be described in detail below with reference to FIG. 24.

In FIG. 24, when the power source of the recording apparatus is turned off in step S401, a control operation by the sub CPU 451 in the power-off control unit 450 is started. In step S402, a temperature measurement period in a power-off state is set to be a maximum of 30 minutes, and a corresponding RAM area is assured. In addition, a sampling time (measurement interval) m is set to be, e.g., 1 minute, and the timer 454 is started.

It is checked in step S403 if one minute has passed in the timer 454. If YES in step S403, the flow advances to step S404, and the present atmosphere temperature is detected by the temperature sensor (e.g., thermistor) arranged in the recording means 411, and the measurement data is stored in the RAM 453. When the data is stored in the RAM 453, if data for 30 minutes have already been stored, data before 30 minutes or more are erased, so that only data for 30 minutes before the power-on operation can be stored. In step S405, it is checked if the power source of the recording apparatus is turned on. If NO in step S405, the flow returns to step S403 to repeat the above-mentioned operations.

If it is determined in step S405 that the power source of the recording apparatus is turned on, the flow advances to step S406, and it is checked based on data stored in the RAM 453 (30 or less data in this embodiment) if the number of temperatures exceeding the standard temperature (e.g., 15° C.) or the number of continuous temperatures exceeding the standard temperature is larger than a predetermined value.

If it is determined in step S406 that the number of temperatures exceeding the standard temperature is equal to or larger than the predetermined value (e.g., 10 times), or that the number of continuous temperatures exceeding the standard temperature is equal to or larger than the predetermined value (e.g., 3 times), it is determined that an atmosphere temperature in the power-off state is high, and an ink in the discharge portion does not so suffer from sticking. The flow advances to step S407, and a recover treatment is performed for a short period of time (e.g., 5 seconds) as a recover operation upon a power-on operation. On the other hand, if it is determined in step S406 that the number of temperatures exceeding the standard temperature is smaller than the predetermined value (e.g., 10 times), or that the number of continuous temperatures exceeding the standard temperature is smaller than the predetermined value (e.g., 3 times), it is determined that the atmosphere temperature in the power-off state is low, and ink in the discharge portion suffers from sticking. The flow then advances to step S408, and a recover treatment is performed for a long period of time (e.g., 20 seconds) as a recover operation upon a power-on operation.

With the above-mentioned recover operation, a recover treatment time upon a power-on operation can be efficiently determined on the basis of degree of ink sticking in a power-off state, and a discharge error or a recording error caused by ink sticking can be reliably prevented. In addition, ink and a recover treatment time can be prevented from being wasted. In the recover operation upon a power-on operation, not only a recover time is set, but also the number of times of preliminary discharge operations may be controlled, or an ink suction force may be controlled, or temperature control of the recording head 411 may be adjusted. Furthermore, a recovery operation attained by combining the above-mentioned operations may be performed.

In the embodiment described above, as parameters for determining a content (time) of a recover operation upon a power-on operation, the number of temperatures exceeding the standard temperature, or the number of continuous temperatures exceeding the standard temperature is used. In place of these parameters, a total value (integrated value) of differences between the standard temperature and measurement temperatures may be used. For example, if the integrated value is larger than 0, it can be determined that an average value of atmosphere temperatures in the power-off state is higher than the standard value, and control is made to shorten a recover time. If the integrated value is smaller than 0 (negative), control can be made to prolong the recover time, thereby reliably removing ink sticking to the discharge portion.

In the above embodiment, temperatures in the power-off state are compared with the standard temperature to determine a content of the recover operation upon a power-on operation. For example, only the timer function of the power-off control unit 450 is operated to measure a power-off time without reading and storing atmosphere temperature values from the temperature sensor 424. When the power-off time is very short (e.g., 10 minutes), it is determined that no ink sticking caused by a change in temperature occurs, and control may be made to start a recording operation without performing the recover operation upon a power-on operation. With this control, a time to the beginning of recording can be shortened, and a throughput can be further improved.

Contrary to this, when the power-off time is very long (e.g., 10 days), since it is difficult to remove sticking ink by a normal recover operation, control may be made to perform a special recover operation (e.g., to continuously perform the normal recover operation four times), thereby preventing a recording error or a discharge error.

In the embodiment described above, a recover operation upon a power-on operation is varied using atmosphere temperatures of the recording means (recording head) 411 as parameters. In some cases, atmosphere humidities may be detected in place of temperatures, and the content of the recover operation upon a power-on operation may be altered using the detected humidities as parameters.

In the above embodiment, the present invention is applied to a serial-type ink jet recording apparatus in which the recording means (recording head) 411 is mounted on the carriage 412 which is moved along the recording medium 418. The present invention can also be applied to an ink jet recording apparatus which employs a line recording means having a length corresponding to the entire or partial recording region in the widthwise direction of a recording medium regardless of the type of scanning system, and the same effects as described above can be obtained. As the recording means (recording head) in the above embodiment, recording means having various structures such as an exchangeable cartridge type recording means in which a recording head and an ink tank are integrated, a recording means having a structure wherein a recording head and an ink tank are separated and are coupled through a coupler or a tube, and the like may be used.

In the above embodiment, the ink jet recording apparatus comprising the single recording means (recording head) 411 has been exemplified. However, the present invention can be applied to an ink jet recording apparatus comprising a plurality of recording means for recording data in different colors, or a gradation recording ink jet recording apparatus comprising a plurality of recording means having the same color but different densities regardless of the number of recording means, and the same effects as described above can be attained.

As can be seen from the above description, in an ink jet recording apparatus for discharging ink from the recording means to perform recording, a time from a previous power-off operation is measured and temperatures near the recording means are measured at predetermined time intervals in a power-off state, so that a recover operation upon a power-on operation of the recording means is altered according to the detected temperatures. Thus, an ink sticking state upon a power-on operation can be correctly judged, and a recover operation upon a power-on operation can be optimized. Thus, an ink jet recording apparatus which can eliminate a recording error caused by a discharge error, prevent wasteful ink consumption and wasted time can be provided.

In addition to the above arrangement, a power-off control unit which receives power from a backup power source or battery in a power-on state, and is started in a power-off state is arranged, and a time from the power-off operation is measured by a timer of the power-off control unit. Thus, an ink jet recording apparatus which can more accurately control a recover operation in addition to the above effects can be provided.

The present invention is particularly suitably usable in an ink jet recording head and recording apparatus for discharging ink by utilizing heat energy. This is because the high density of the picture element and the high resolution of the recording are possible.

The typical structure and the operational principle of preferably the one disclosed in U.S. Pat. Nos. 4,723,129 and 4,740,796. The principle is applicable to a so-called on-demand type recording system and a continuous type recording system. Particularly however, the principle is suitable for the on-demand type because at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the development and collapse of the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion in addition to the structure of the combination of the ejection outlet, liquid passage and the electrothermal transducer as disclosed in the above-mentioned patents. In addition, the present invention is applicable to the structure disclosed in Japanese Laid-Open Patent Application Publication No. 123670/1984, wherein a common slit is used as the ejection outlet for plural electrothermal transducers, and to the structure disclosed in Japanese Laid-Open Patent Application No. 138461/1984 wherein an opening for absorbing the pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and a plural recording head combined to cover the entire width.

In addition, the present invention is applicable to a serial type recording head wherein the recording head is fixed on the main assembly, to a replaceable chip type recording head which is connected electrically with the main apparatus and can be supplied with the ink by being mounted in the main assembly, or to a cartridge type recording head having an integral ink container.

The provision of the recovery means and the auxiliary means for the preliminary operation are preferable because they can further stabilize the effect of the present invention. As for such means, there are capping means for the recording head, cleaning means therefor, pressing or sucking means, preliminary heating means by the ejection electrothermal transducer or by a combination of the ejection electrothermal transducer and additional heating element and means for preliminary ejection not for the recording operation, which can stabilize the recording operation.

As regards the kinds of the recording head mountable, it may be a single head corresponding to a single color ink, or may be plural heads corresponding to the plurality of ink materials having different recording color or density. The present invention is effectively applicable to an apparatus having at least one of a monochromatic mode mainly with black and a multi-color with different color ink materials and a full-color mode by the mixture of the colors which may be an integrally formed recording unit or a combination of plural recording heads.

Furthermore, in the foregoing embodiment, the ink has been liquid. It may be, however, an ink material solidified at the room temperature or below and liquefied at the room temperature. Since in the ink jet recording system, the ink is controlled within the temperature not less than 30° C. and not more than 70° C. to stabilize the viscosity of the ink to provide the stabilized ejection, in usual recording apparatus of this type, the ink is liquid within the temperature range when the recording signal is applied. In addition, the temperature rise due to the thermal energy is positively prevented by consuming it for the state change of the ink from the solid state to the liquid state, or the ink material is solidified when it is used to prevent the evaporation of the ink. In either case, by application of the recording signal producing thermal energy, the ink may be liquefied, and the liquefied ink may be ejected. The ink may start to be solidified at the time when it reaches the recording material. The present invention is applicable to such an ink material as is liquefied by the application of the thermal energy. Such an ink material may be retained as a liquid or solid material on through holes or recesses formed in a porous sheet as disclosed in Japanese Laid-Open Patent Application No. 56847/1979 and Japanese Laid-Open Patent Application No. 71260/1985. The sheet faces the electrothermal transducers. The most effective one for the ink materials disclosed above is the film boiling system.

The ink jet recording apparatus may be used as an output terminal of an information processing apparatus such as computer or the like, a copying apparatus combined with an image reader or the like, or a facsimile machine having information sending and receiving functions.

According to the present invention, at least one side of the four sides of the orifice plates are not bonded with the front seal plate, and therefore, even if the front seal is influenced by the difference in the thermal expansions of various elements, the force applied to the orifice plate can be significantly reduced, and the deformation or the crack production of the orifice plate of the top plate can be prevented.

Therefore, the cause of inferior print quality can be removed, and therefore the ink jet recording head cartridge and an ink jet recording apparatus using the same can be provided which can produce high quality print reliably under various conditions.

While the invention has been described with reference to the structures disclosed herein, it is not confined to the details set forth and this application is intended to cover such modifications or changes as may come within the purposes of the improvements or the scope of the following claims.

What is claimed is:

1. A recovery method for recovering an ink jet apparatus having an ink jet head with a discharge opening for discharging ink, a cap for capping the discharge opening, and time counting means for counting a first lapse time being a time elapsed initiated from a time at which the cap caps the discharge opening and while the cap caps the discharge opening and a second lapse time being a time elapsed from a termination of a latest discharge from the discharge opening, the method comprising the steps of:

judging whether or not the discharge opening is capped by the cap;

performing a recovery operation selected from a plurality of recovery operations for the ink jet apparatus in accordance with the first lapse time in a case that a result of said judging step is that the discharge opening is capped; and performing a recovery operation selected from a plurality of recovery operations for the ink jet apparatus in accordance with the second lapse time in a case that the result of said judging step is that the discharge opening is not capped.

2. A recovery method according to claim 1, wherein one of three different recovery operations is performed if the result of the judging step is that the discharge opening is capped.

3. A recovery method according to claim 2, further including the steps of determining a length of time during which said discharge opening has been capped and selecting one of said three different recovery operations depending on a result of said determining step.

4. A recovery method according to claim 3, wherein a first recovery operation comprising an idle discharge operation in which ink is discharged through said discharge opening is performed when said length of time is less than a first predetermined value, a second recovery operation comprising an ink absorbing operation in which a predetermined amount of ink is forced out of said discharge opening is performed when said length of time is at least said first predetermined value and less than a second predetermined value, and a third recovery operation comprising said idle discharge operation and multiple said ink absorbing operations is performed when said length of time is at least said second predetermined value.

5. A recovery method according to claim 4, wherein said first predetermined value is one hour and said second predetermined value is 24 hours.

6. A recovery method according to claim 1, wherein one of two different recovery operations is performed if the result of the judging step is that the discharge opening is not capped.

7. A recovery method according to claim 6, further including the step of determining a length of time during which said discharge opening has not been capped since a last ink discharge therethrough and selecting one of the two recovery operations depending on a result of said determining step.

8. A recovery method according to claim 7, wherein a first recovery operation comprising an idle discharge operation in which ink is discharged through said discharge opening and a first plurality of ink absorbing operations in each of which a predetermined amount of ink is forced out of said discharge opening is performed when said predetermined length of time is less than a predetermined value, and a second recovery operation comprising said idle discharge operation and a second plurality of said ink absorbing operations in excess of said first plurality is performed when said predetermined length of time is at least said predetermined value.

9. A recovery method according to claim 8, wherein said predetermined value is 24 hours, said first plurality is three, and said second plurality is five.

10. A recovery method according to claim 1, wherein the ink jet head includes electrothermal transducers for generating thermal energy to discharge the ink from the discharge opening.

11. A recovery method according to claims 10, wherein the thermal energy generated by the electrothermal transducers causes film boiling in the ink.

12. A recovery method according to claim 11, wherein the film boiling results in formation of a bubble in the ink, whereby the ink is discharged from the discharge opening.

* * * * *

UNITED STATES PATENT AND TRADEMARK OFFICE

CERTIFICATE OF CORRECTION

PATENT NO. : 6,109,724
DATED : August 29, 2000
INVENTOR(S) : Takahashi et al.

It is certified that error appears in the above-identified patent and that said Letters Patent is hereby corrected as shown below:

Title page,
FOREIGN PATENT DOCUMENTS,.

| | | |
|---|---|---|
| "1180352 | 7/1989 | Japan" should read |
| -- 1-180352 | 7/1989 | Japan --. |

Abstract,
Line 2, "measring" should read, -- measuring --.

Column 1,
Line 21, "used," should read -- used --; and
Line 22, "individually" should read -- individually, --.

Column 2,
Line 38, "the" should read -- a --;
Line 39, "a" should read -- the --; and
Line 54, "is conducted" should read -- is conducted, is --.

Column 3,
Line 30, "an" should be deleted.

Column 4,
Line 33, "minutes" should read -- minute --.

Column 10,
Line 3, "reache is" should read -- reaches --.

Column 11,
Line 21, "In" should be deleted; and
Line 43, "10Y " should read -- 101Y --.

Column 12,
Line 47, "also" should be deleted.

Column 23,
Line 7, "so" should be deleted.

UNITED STATES PATENT AND TRADEMARK OFFICE

CERTIFICATE OF CORRECTION

PATENT NO. : 6,109,724
DATED : August 29, 2000
INVENTOR(S) : Takahashi et al.

It is certified that error appears in the above-identified patent and that said Letters Patent is hereby corrected as shown below:

Column 28,
Line 37, Claim 13 should be inserted as follows:
-- 13. A recovery method for recovering an ink jet apparatus having an ink jet head with a discharge opening for discharging ink and a cap for capping said discharge opening, said method comprising the steps of:
judging whether or not the discharge opening is capped by the cap;
performing a recovery operation selected from a plurality of recovery operations for the ink jet apparatus in accordance with a first lapse time elapsed initiated from a time at which the cap caps the discharge opening and while the cap caps the discharge opening in a case that a result of said judging step is that the discharge opening is capped; and
performing a recovery operation selected from a plurality of operations for the ink jet apparatus in accordance with a second lapse time elapsed from a termination of a latest discharge from the discharge opening in a case that the result of said judging step is that the discharge opening is not capped. --

Signed and Sealed this

Thirteenth Day of November, 2001

*Attest:*

Nicholas P. Godici

NICHOLAS P. GODICI
*Acting Director of the United States Patent and Trademark Office*

*Attesting Officer*